US012460638B2

(12) United States Patent
Lee et al.

(10) Patent No.: US 12,460,638 B2
(45) Date of Patent: Nov. 4, 2025

(54) SCROLL COMPRESSOR

(71) Applicant: LG ELECTRONICS INC., Seoul (KR)

(72) Inventors: Kangwook Lee, Seoul (KR); Yongkyu Choi, Seoul (KR); Cheolhwan Kim, Seoul (KR); Howon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/845,125

(22) PCT Filed: Mar. 9, 2023

(86) PCT No.: PCT/KR2023/003247
§ 371 (c)(1),
(2) Date: Sep. 9, 2024

(87) PCT Pub. No.: WO2023/172089
PCT Pub. Date: Sep. 14, 2023

(65) Prior Publication Data

US 2025/0180018 A1 Jun. 5, 2025

(30) Foreign Application Priority Data

Mar. 11, 2022 (KR) ..... 10-2022-0030900

(51) Int. Cl.
*F04C 18/02* (2006.01)
*F04C 23/02* (2006.01)
(Continued)

(52) U.S. Cl.
CPC ..... *F04C 18/0215* (2013.01); *F04C 23/02* (2013.01); *F04C 29/0042* (2013.01);
(Continued)

(58) Field of Classification Search
CPC .... F04C 18/0215; F04C 23/02; F04C 23/008; F04C 29/0042; F04C 29/023; F04C 29/00;
(Continued)

(56) References Cited

U.S. PATENT DOCUMENTS 5,505,596 A * 4/1996 Nakamura ..... F04C 23/008 418/94
5,573,389 A * 11/1996 Fukuhara ..... F01C 21/02 418/57
(Continued)

FOREIGN PATENT DOCUMENTS

CN 101216034 7/2008
EP 4321756 2/2021
(Continued)

OTHER PUBLICATIONS

Machine Translation JP 2007-162571 (Year: 2025).*
(Continued)

*Primary Examiner* — Dapinder Singh
(74) *Attorney, Agent, or Firm* — KED & ASSOCIATES

(57) ABSTRACT

A scroll compressor, including a casing that forms an outer appearance thereof and having an oil storage space; an electromotive part installed inside of the casing to generate a drive force; a rotational shaft rotatably installed in the electromotive part; a compression part having an orbiting scroll installed to be capable of orbital rotation around the rotational shaft and a fixed scroll coupled to and engaged with the orbiting scroll to form a compression chamber between the orbiting scroll and the fixed scroll; and a bushing disposed between the fixed scroll and the rotational shaft and coupled to an outer circumference of the rotational shaft so as to rotate with the rotational shaft. The bushing is supported by one surface provided inside of the fixed scroll.

19 Claims, 25 Drawing Sheets

(51) Int. Cl.
*F04C 29/00* (2006.01)
*F04C 29/02* (2006.01)

(52) U.S. Cl.
CPC ..... *F04C 29/023* (2013.01); *F04C 2240/40* (2013.01); *F04C 2240/56* (2013.01); *F04C 2240/603* (2013.01)

(58) Field of Classification Search
CPC ..... F04C 2240/40; F04C 2240/56; F04C 2240/603; F04C 2240/30; F04C 2240/50
See application file for complete search history.

(56) References Cited

U.S. PATENT DOCUMENTS

| | | | | |
|---|---|---|---|---|
| 7,901,194 | B2 * | 3/2011 | Beers | F04C 29/0071 464/182 |
| 9,945,378 | B2 * | 4/2018 | Kouno | F04C 28/26 |
| 2009/0257900 | A1 * | 10/2009 | Beers | F04C 29/0071 29/525 |

FOREIGN PATENT DOCUMENTS

| | | |
|---|---|---|
| EP | 3945211 | 2/2022 |
| EP | 3957854 | 2/2022 |
| JP | 06-10864 | 1/1994 |
| JP | 07-83179 | 3/1995 |
| JP | 10-288171 | 10/1998 |
| JP | 2004-293479 | 10/2004 |
| JP | 2007-162571 | 6/2007 |
| KR | 10-0631724 | 10/2006 |
| KR | 10-2013-0031734 | 3/2013 |
| KR | 10-2019-0011115 | 2/2019 |

OTHER PUBLICATIONS

International Search Report issued in Application No. PCT/KR2023/003247 dated Jun. 8, 2023.
European Search Report dated May 27, 2025 issued in Application No. 23767190.4.

* cited by examiner

*FIG. 24*

| | RELATED ART | AFTER APPLYING CONCENTRIC BUSH |
|---|---|---|
| SURFACE PRESSURE [MPa] @ARI 60Hz | 100% | 84% |
| SOMMERFELD NUMBER Sf @6/18,G 10Hz | 100% | 223% |

SCROLL COMPRESSOR

CROSS-REFERENCE TO RELATED PATENT APPLICATIONS

This application is a U.S. National Stage Application under 35 U.S.C. § 371 of PCT Application No. PCT/KR2023/003247, filed on Mar. 9, 2023, which claims priority to Korean Patent Application No. 10-2022-0030900 filed on Mar. 11, 2022, whose entire disclosures are hereby incorporated by reference.

TECHNICAL FIELD

The present disclosure relates to a scroll compressor, and more particularly, to a scroll compressor for reducing wear of a sliding part due to reduced lubrication of a compression part caused by a gap between a shaft and a concentric bush.

BACKGROUND ART

In general, a compressor is applied to a vapor compression type refrigeration cycle (hereinafter, simply referred to as a refrigeration cycle), such as a refrigerator or an air-conditioner. Compressors may be classified into a reciprocal type, a rotary type, a scroll type, and the like according to a method of compressing refrigerant.

Among those compressors, a reciprocal compressor is a compressor in which gas is compressed by a reciprocating motion of a piston within a cylinder, and a scroll compressor is compressor in which a compression chamber is formed between a fixed wrap of a fixed scroll and an orbiting wrap of an orbiting scroll as the orbiting scroll engaged with the fixed scroll, fixed to an inner space of a hermetic case, performs an orbiting motion.

A scroll compressor is configured such that an orbiting scroll and a fixed scroll are engaged with each other and a pair of compression chambers is formed while the orbiting scroll performs an orbiting motion with respect to the fixed scroll.

The compression chamber includes a suction pressure chamber formed at an outer side, an intermediate pressure chamber continuously formed toward a central portion from the suction pressure chamber while gradually decreasing in volume, and a discharge pressure chamber connected to a center of the intermediate pressure chamber. Typically, the suction pressure chamber is formed through a side surface of the fixed scroll, the intermediate pressure chamber is sealed, and the discharge pressure chamber is formed through an end plate of the fixed scroll.

Scroll compressors may be classified into a low-pressure type and a high-pressure type according to a path through which refrigerant is suctioned. The low-pressure type is configured such that a refrigerant suction pipe is connected to an inner space of a casing to guide suction refrigerant of low temperature to flow into a suction pressure chamber via the inner space of the casing. On the other hand, the high-pressure type is configured such that the refrigerant suction pipe is connected directly to the suction pressure chamber to guide refrigerant to flow directly into the suction pressure chamber without passing through the inner space of the casing.

In addition, scroll compressors may be classified into a top-compression type or a bottom-compression type depending on positions of an electromotive part and a compression part. The top-compression type is configured such that the compression part is located above the electromotive part, whereas the bottom-compression type is configured such that the compression part is located below the electromotive part.

Patent Document 1 (KR Patent Publication No. 10-2019-0011115 (Feb. 1, 2019)) discloses a scroll compressor including: a casing in which oil is stored in a lower oil storage space; an electromotive part disposed in an inner space of the casing; a rotation shaft coupled to the electromotive part, having an oil supply passage to guide oil stored in the oil storage space of the casing upward, and including an oil hole penetrating from the oil supply passage to an outer circumferential surface thereof; a main frame installed along the rotation shaft and disposed below the drive motor; a fixed scroll installed along the rotation shaft and disposed below the main frame; and an orbiting scroll disposed between the main frame and the fixed scroll, having the rotation shaft inserted eccentrically therein, and performing an orbital motion in an engaged state with the fixed scroll to form a compression chamber with the fixed scroll, wherein oil guided upward through the oil supply passage is discharged through the oil hole to be supplied on an outer circumferential surface of the rotation shaft.

The scroll compressor of Patent Document 1 has a structure in which the rotation shaft, the orbiting scroll, and the fixed scroll are assembled in that order, so there has been a limitation on a diameter of a fixed scroll bearing. That is, due to the assembly structure, the diameter of the fixed scroll bearing must be designed to be smaller than a value obtained by subtracting twice the eccentricity from a diameter of an orbiting scroll bearing (fixed scroll bearing diameter<orbiting scroll bearing diameter−eccentricity*2).

In addition, since the limitation restricts the bearing of the fixed scroll from being expanded, the bearing relatively has the smallest diameter and the highest surface pressure, and becomes vulnerable to reliability. If the bearing of the fixed scroll is expanded to reduce the surface pressure, the bearing of the orbiting scroll must also be expanded, which causes the problem of a reduction in a compression space.

If the compression space is reduced due to the expansion of the bearing of the orbiting scroll, a stroke volume is reduced, a compression ratio is reduced, and a wrap thickness is inevitably reduced, thereby lowering efficiency and reliability of the scroll compressor.

Also, there are two ways to couple a concentric bushing to a crankshaft, including "press-fitting" with a negative gap and sliding "insertion" with a plus gap between an outer diameter of the crankshaft and an inner diameter of the concentric bushing. In the case of the insertion, a gap of several micrometers (μm) to several tens of μm is generated depending on a gap setting, and when refrigerant enters or exits a compression part through this gap, a differential pressure oil supply function is reduced or does not work in a scroll compressor that employs a differential pressure oil supply structure. This interferes with smooth oil supply to the inside of the compression part and a bearing portion, which may cause problems, such as deteriorated reliability and efficiency.

That is, if refrigerant leaks in the gap between the concentric bushing and the crankshaft, an oil supply path is open and differential pressure is broken. As a result, in the scroll compressor that employs the differential pressure oil supply structure, a one-way path by the differential oil supply is not formed and the oil supply to the inside of the compression part and the bearing portion is failed.

In this way, a quality risk may arise due to the presence of the gap between the outer diameter of the shaft and the inner diameter of the concentric bushing. This causes a problem of wear of a sliding part and an increase in friction loss due to reduced lubrication of the compression part, and a problem of an increase in indication loss due to increased leakage between compression chambers.

Therefore, there is a need of a structure for blocking refrigerant movement with respect to the insertion-type concentric bushing structure.

DISCLOSURE OF INVENTION

Technical Problem

The present disclosure has been made to solve the above problems, and a first aspect of the present disclosure is to provide a scroll compressor having a structure that is capable of reducing surface pressure applied to a bearing of a fixed scroll by expanding the bearing size of the fixed scroll or securing a sufficient area of the bearing.

A second aspect of the present disclosure is to provide a scroll compressor having a structure that is capable of securing a compression space by way of increasing a diameter of a bearing of a fixed scroll without expanding a bearing of an orbiting scroll.

A third aspect of the present disclosure is to provide a scroll compressor having a structure that is capable of employing an existing assembling method while increasing a diameter of a bearing of a fixed scroll to reduce surface pressure.

A fourth aspect of the present disclosure is to provide a scroll compressor for reducing wear of a sliding part due to reduced lubrication of a compression part caused by a gap between a shaft and a concentric bushing.

A fifth aspect of the present disclosure is to provide a scroll compressor having a sealable structure that suppresses refrigerant from flowing in a gap between a concentric bushing and a shaft.

A sixth aspect of the present disclosure is to provide a scroll compressor for attenuating problems of an increase in friction loss and an increase in indication loss due to an increased leakage between compression chambers.

Solution to Problem

In order to achieve the aspect of the present disclosure, there is provided a scroll compressor comprising: a casing that defines appearance and has an oil storage space; an electromotive part that is installed inside the casing to generate driving force; a rotation shaft that is rotatably installed in the electromotive part; a compression part that includes an orbiting scroll installed on the rotation shaft to perform an orbital motion, and a fixed scroll engaged with the orbiting scroll to form a compression chamber together with the orbiting scroll; and a bushing that is disposed between the fixed scroll and the rotation shaft, and coupled to an outer circumference of the rotation shaft to rotate together with the rotation shaft, wherein the bushing is supported by one surface defined inside the fixed scroll.

With this configuration, by the application of a concentric bushing structure, surface pressure applied between the fixed scroll and the bushing can be reduced, a load-bearing capacity can be increased, and thus the Sommerfeld number can be increased, thereby enhancing reliability.

The scroll compressor according to the present disclosure may further include a fixed bearing that is disposed between the fixed scroll and the bushing and fitted to an inner circumference of the fixed scroll, and the bushing may be supported on an inner surface of the fixed bearing.

With this configuration, by the application of the concentric bushing structure, surface pressure applied to the fixed scroll, the bushing, and the fixed bearing can be reduced, load-bearing capacity can be increased, and thus the Sommerfeld number can be increased, thereby enhancing reliability.

The bushing may include an oil supply hole formed such that inside and outside of the bushing communicate with each other, and the rotation shaft may include an oil supply opening formed to communicate with the oil supply hole.

With the configuration, oil inside the rotation shaft can flow to the outer circumference of the bushing through the oil supply opening and the oil supply hole, to thusly be supplied to the compression part.

According to one example related to the present disclosure, an oil groove may be formed in an inner circumference of the bushing or the outer circumference of the rotation shaft, and the oil groove may be formed in a circumferential direction. This enables the formation of an oil film while oil is accommodated in the oil groove.

Preferably, the oil groove may include an oil film forming portion formed in the circumferential direction together with the outer circumference of the rotation shaft or the inner circumference of the bushing, and filled with oil. This can allow the formation of the oil film along the oil film forming portion in the circumferential direction.

A gap passage may be formed between the inner circumference of the bushing and the outer circumference of the rotation shaft, to allow oil to flow into the oil groove therethrough.

A passage groove may be formed concavely by a predetermined width in an outer circumference of the bushing to communicate with the oil supply hole, so that oil is guided toward the fixed scroll.

The passage groove may be formed to receive the oil supply hole therein.

Accordingly, as soon as oil inside the rotation shaft flows out to the outer circumference of the bushing through the oil supply opening and the oil supply hole, the oil can be supplied to the compression part through the passage groove. This can make it easier to supply the oil to the compression part.

Preferably, the passage groove may be formed up to a top of the bushing.

According to another example related to the present disclosure, the oil groove may be formed to be in communication with the oil supply hole or the oil supply opening.

The oil groove may be spaced downwardly apart from the oil supply hole or the oil supply opening.

The oil groove may be spaced upwardly apart from the oil supply hole or the oil supply opening.

The bushing may include an oil supply hole formed such that inside and outside of the bushing communicate with each other, and the rotation shaft may include an oil supply opening formed to be spaced apart from the oil supply hole in one direction.

Oil grooves may be formed respectively in an inner circumference of the bushing and the outer circumference of the rotation shaft, and the oil grooves in the inner circumference of the bushing and the outer circumference of the rotation shaft may be formed in a circumferential direction to enable formation of an oil film while oil is accommodated in the oil grooves.

Preferably, the oil groove in the inner circumference of the bushing and the oil groove in the outer circumference of the rotation shaft may be disposed at the same height.

In addition, the oil groove in the inner circumference of the bushing and the oil groove in the outer circumference of the rotation shaft may be disposed to be spaced apart from each other in one direction.

In order to achieve another aspect of the present disclosure, there is provided a scroll compressor including: a casing that defines appearance and has an oil storage space; an electromotive part that is installed inside the casing to generate driving force; a rotation shaft that is rotatably installed in the electromotive part; a compression part that comprises an orbiting scroll installed on the rotation shaft to perform an orbital motion, and a fixed scroll engaged with the orbiting scroll to form a compression chamber together with the orbiting scroll; a bushing that is disposed between the fixed scroll and the rotation shaft, and coupled to an outer circumference of the rotation shaft to rotate together with the rotation shaft; and a fixed bearing that is disposed between the fixed scroll and the bushing and is fitted to an inner circumference of the fixed scroll, wherein the bushing rotates in a sliding manner relative to the fixed bearing, and is supported by one surface defined inside the fixed bearing. With this configuration, by the application of the concentric bushing structure, surface pressure applied to the fixed scroll, the bushing, and the fixed bearing can be reduced, load-bearing capacity can be increased, and thus the Sommerfeld number can be increased, thereby enhancing reliability.

A key receiving groove may be formed in the outer circumference of the rotation shaft in an axial direction, a key may be installed in the key receiving groove to protrude in a radial direction of the rotation shaft, and a support groove may be formed in an inner circumference of the bushing, such that the key is fitted to support the bushing in a circumferential direction.

This can allow the bushing to be supported in the circumferential direction by installing the key in the key receiving groove and fitting the key to the inner circumference of the bushing.

Preferably, the key and the support groove may be formed so that an axial length is longer than a radial length.

A pin may be inserted into the outer circumference of the rotation shaft in the radial direction, and the bushing may include a pin coupling hole into which the pin is inserted to be supported in the radial direction.

As the pin coupling hole is disposed in the bushing and the pin is inserted into the pin coupling hole, the bushing can be supported with respect to the rotation shaft.

The scroll compressor according to the present disclosure may further include a fixed bearing that is disposed between the fixed scroll and the bushing and fitted to an inner circumference of the fixed scroll, and the bushing may slidably rotate relative to the fixed bearing.

As the bushing is coupled between the fixed bearing and the rotation shaft to rotate together with the rotation shaft, an inner diameter of the fixed bearing can be increased by a thickness of the bushing, and surface pressure applied to the inside of the fixed bearing can be reduced.

In addition, the rotation shaft to which the bushing is coupled may include a large-diameter portion and a small-diameter portion formed on portions in contact with the bushing and having different diameters, and the bushing may include a first hole receiving and supporting the large-diameter portion, and a second hole receiving and supporting the small-diameter portion.

Since the first hole of the bushing is received and supported in the large-diameter portion of the rotation shaft, and the second hole is received and supported in the small-diameter portion, the bushing can be supported across the first hole and the second hole of the rotation shaft.

Especially, the large-diameter portion may include a support surface formed on at least a portion of an outer circumference thereof by cutting an outer circumferential surface in a tangential direction, and supports the first hole of the bushing, and the first hole of the bushing may include a holding surface formed in parallel to the support surface to support the support surface.

By the structure having the support surface of the large-diameter portion and the holding surface of the first hole, the bushing can be firmly supported on the rotation shaft.

Preferably, the support surface may be provided by two disposed in parallel to each other on the outer circumference of the rotation shaft, and the holding surface may be provided by two disposed in parallel to correspond to the support surfaces.

In addition, the large-diameter portion may include a support end portion disposed on a bottom surface thereof to axially support the bushing between the large-diameter portion and the small-diameter portion, and a mounting surface may be disposed on a top of the second hole, and mounted on the support end portion.

By the structure in which the mounting surface of the bushing is mounted on the support end portion disposed on the bottom surface of the large-diameter portion, the bushing can be locked by the support end portion and restricted from moving upward while being coupled to the rotation shaft.

A pin may be inserted into the outer circumference of the rotation shaft in a radial direction, and the bushing may include a pin coupling hole into which the pin is inserted to be supported in the radial direction. By this structure, the bushing can be radially supported with respect to the rotation shaft.

The fixed scroll may include a sealing surface portion that protrudes inwardly from one surface thereof facing the orbiting scroll to seal the compression chamber, and a lower portion of the sealing surface portion may be spaced apart from an upper surface of the bushing by a predetermined distance.

The sealing surface can protrude further inward than a position where the inner circumference of the fixed bearing is arranged, so as to suppress the communication between the compression chamber and the fixed bearing and seal the compression chamber.

A pin may be inserted into the outer circumference of the rotation shaft in a radial direction, and the bushing may include a pin coupling hole into which the pin is inserted to be supported in the radial direction. By this structure, the bushing can be radially supported with respect to the rotation shaft.

The pin coupling hole may be provided in plurality in an outer circumference of the bushing along a circumferential direction, and the pin may be provided in plurality to be inserted into the plurality of pin coupling holes, respectively.

As the plurality of pin coupling holes and the plurality of pins are provided, the bushing can be firmly supported in the circumferential direction with respect to the rotation shaft.

The rotation shaft may include: a fixed bearing portion that is installed to be coupled to the inner circumference of the fixed scroll; and an eccentric part that is connected to the fixed bearing portion, arranged on the an circumference of the orbiting scroll, and eccentrically arranged on the fixed bearing portion to enable the orbiting scroll to orbitally rotate eccentrically by rotational force transmitted from the electromotive part, and the bushing may be arranged concentrically with the fixed bearing portion.

An anti-separation member may be installed on the outer circumference of the rotation shaft to support the lower surface of the bushing, such that the bushing is supported in an axial direction.

In addition, the rotation shaft may include a fixed bearing portion that is installed to be coupled to the inner circumference of the fixed scroll, and the fixed bearing portion may include an anti-separation receiving groove formed concavely in a circumferential direction in an outer circumference of the fixed bearing portion to receive the anti-separation member.

As the anti-separation member is installed in the anti-separation receiving groove, the downward movement of the bushing can be restricted by the anti-separation member, so that the bushing can be supported in the axial direction.

The rotation shaft may be arranged to penetrate the fixed scroll.

Advantageous Effects of Invention

In the scroll compressor according to the present disclosure, the oil groove can be formed between the bushing and the rotation shaft, and oil flowing into the oil groove can form an oil film, so that refrigerant leakage is suppressed, resulting in enabling a differential pressure oil supply system in a compression part to operate normally without any problems.

In addition, in the scroll compressor according to the present disclosure, by expanding the diameter of the bearing of the fixed scroll by virtue of applying the concentric bushing structure, surface pressure can be reduced, load-bearing capacity can be increased, and thus the Sommerfeld number can be increased, thereby enhancing reliability.

Accordingly, the scroll compressor according to the present disclosure can reduce internal leakage and an increase in friction loss by virtue of the concentric bushing, thereby reducing efficiency deterioration of the compressor or an occurrence of dispersion associated with the efficiency deterioration.

In the scroll compressor according to the present disclosure, an effect of forming an oil film using oil in a gap between components can be achieved, thereby suppressing abnormal noise generated due to a micro-contact or vibration between the components during operation.

In the scroll compressor according to the present disclosure, size expansion or sufficient area of the bearing of the fixed scroll can be secured, thereby reducing surface pressure applied to the bearing of the fixed scroll.

In the scroll compressor according to the present disclosure, by installing the bushing between the rotation shaft and the fixed bearing, the diameter of the fixed bearing can be expanded while securing a sufficient compression space because the bearing of the orbiting scroll is not expanded.

In the scroll compressor according to the present disclosure, the fixed bearing portion has the large-diameter portion and the bushing has a predetermined outer diameter or width. Accordingly, the fixed bearing installed on the inner circumference of the fixed scroll can have a relatively large diameter by the outer diameter of the bushing, surface pressure applied to the fixed bearing can be reduced, and the Sommerfeld number can be increased.

In addition, in the scroll compressor according to the present disclosure, the sealing surface portion can protrude further inward than a position where the inner circumference of the fixed bearing is arranged, so as to suppress the communication between the compression chamber and the fixed bearing and seal the compression chamber.

In addition, in the scroll compressor of the present disclosure, the bushing can be supported radially with respect to the fixed scroll by the D-cut structure, the pin structure, and the key structure.

In addition, in the scroll compressor according to the present disclosure, the bushing can be axially supported with respect to the fixed scroll by the anti-separation member supporting the bottom of the bushing.

BRIEF DESCRIPTION OF DRAWINGS

FIG. 24 is a table comparing surface pressure and Sommerfeld number of the present disclosure and the related art.

MODE FOR THE INVENTION

Hereinafter, description will be given in more detail of a scroll compressor 10, 20 according to the present disclosure, with reference to the accompanying drawings.

For the sake of brief description with reference to the drawings, the same or equivalent components may be provided with the same or similar reference numbers, and description thereof will not be repeated.

In addition, a structure that is applied to one embodiment will be equally applied to another embodiment as long as there is no structural and functional contradiction in the different embodiments.

A singular representation may include a plural representation unless it represents a definitely different meaning from the context.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
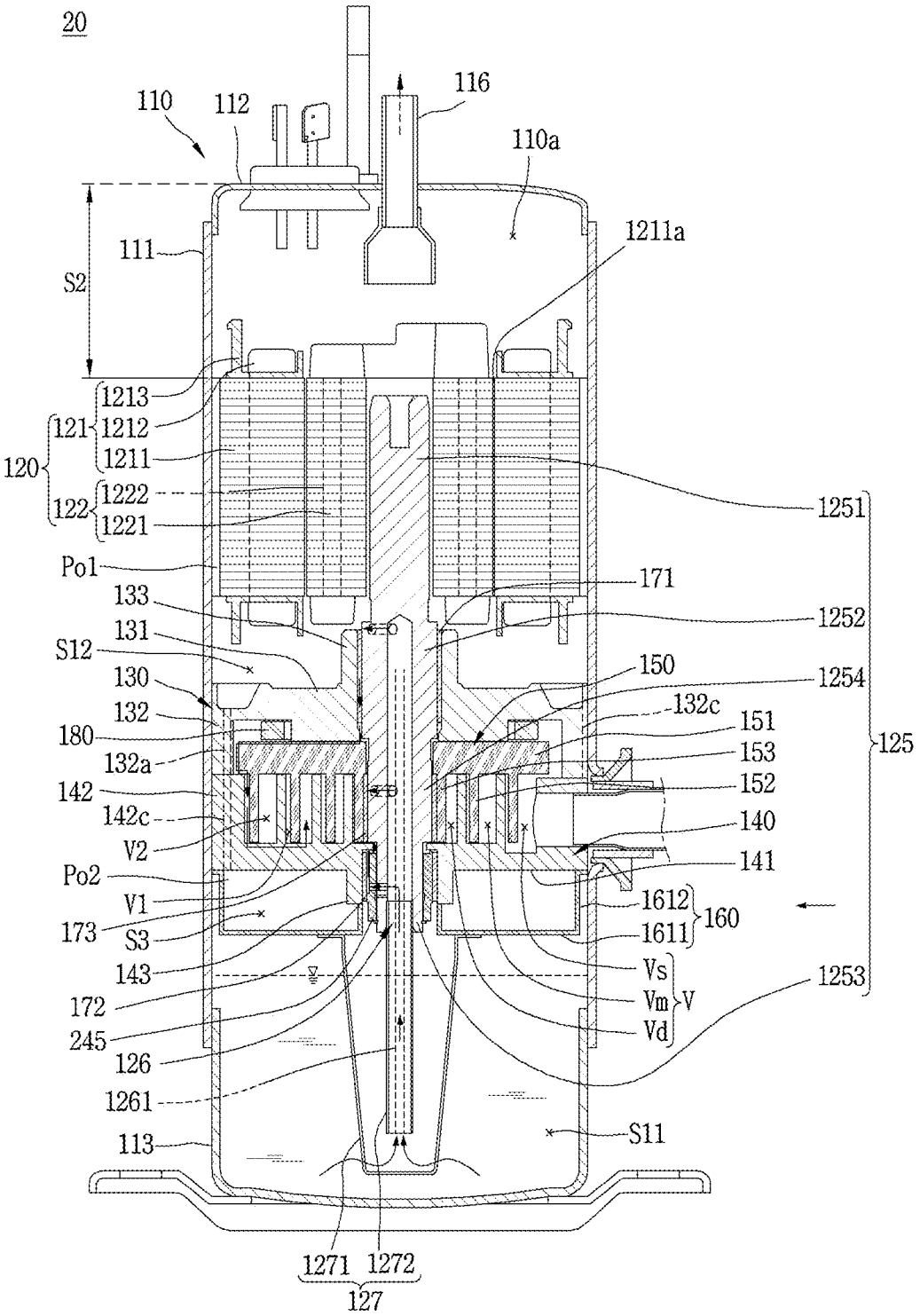
FIG. 1 is a cross-sectional view illustrating a scroll compressor according to the present disclosure.
Figure 2:
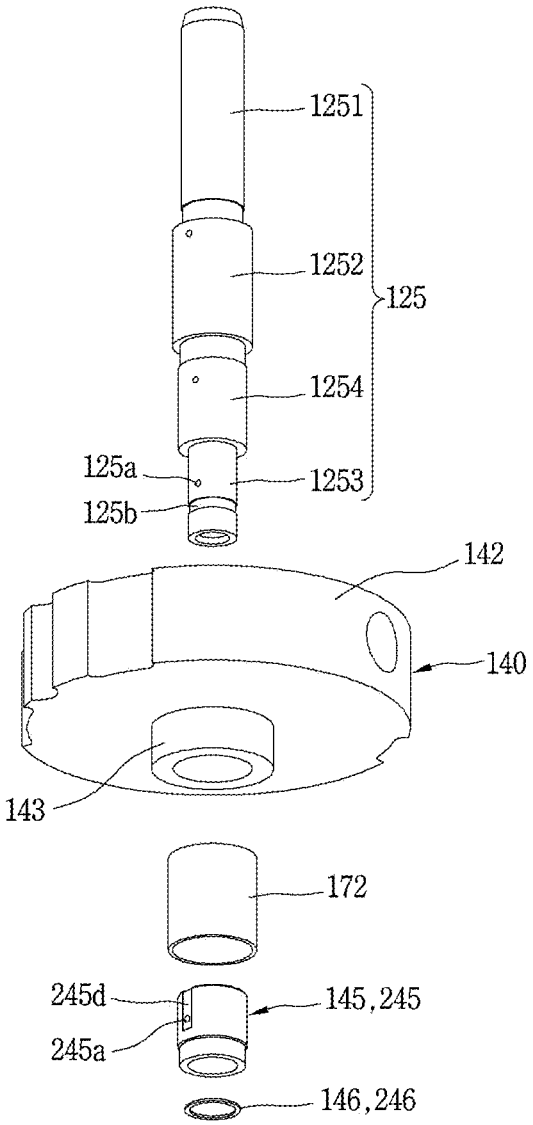
FIG. 2 is an exploded perspective view illustrating a rotation shaft, a bushing, and a fixed scroll of the present disclosure.
Figure 3:
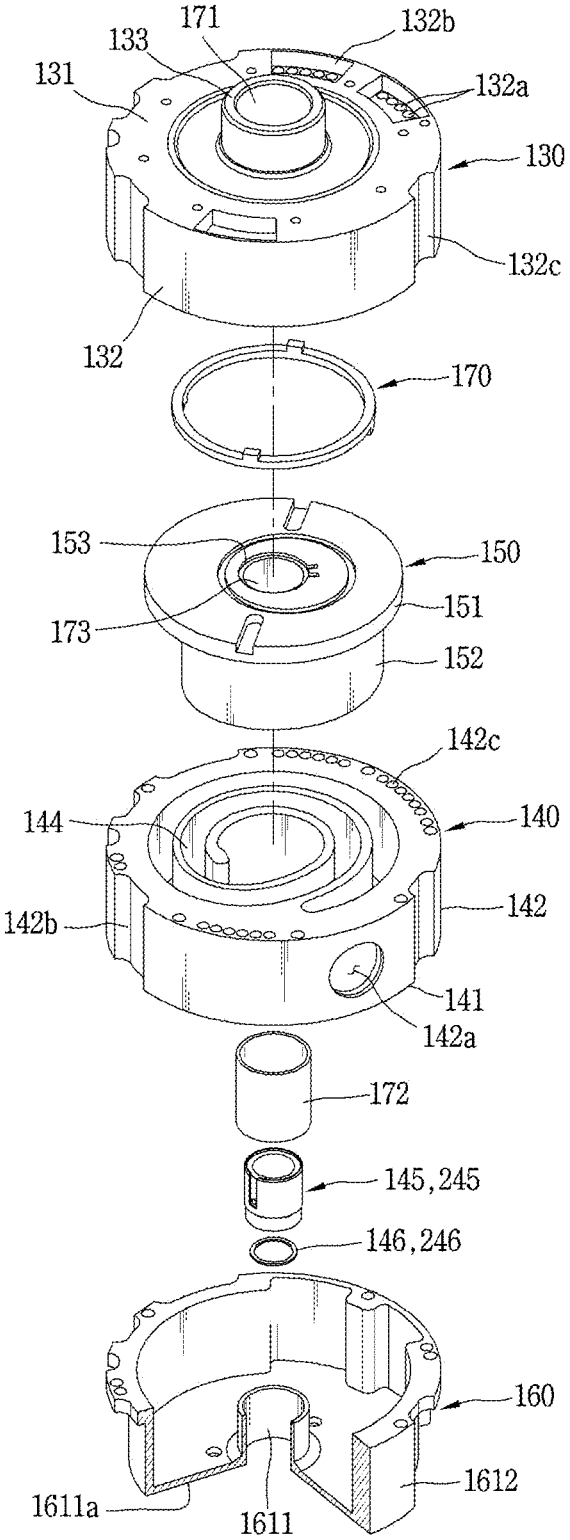
FIG. 3 is an exploded perspective view of a part of FIG. 1.
Figure 4:
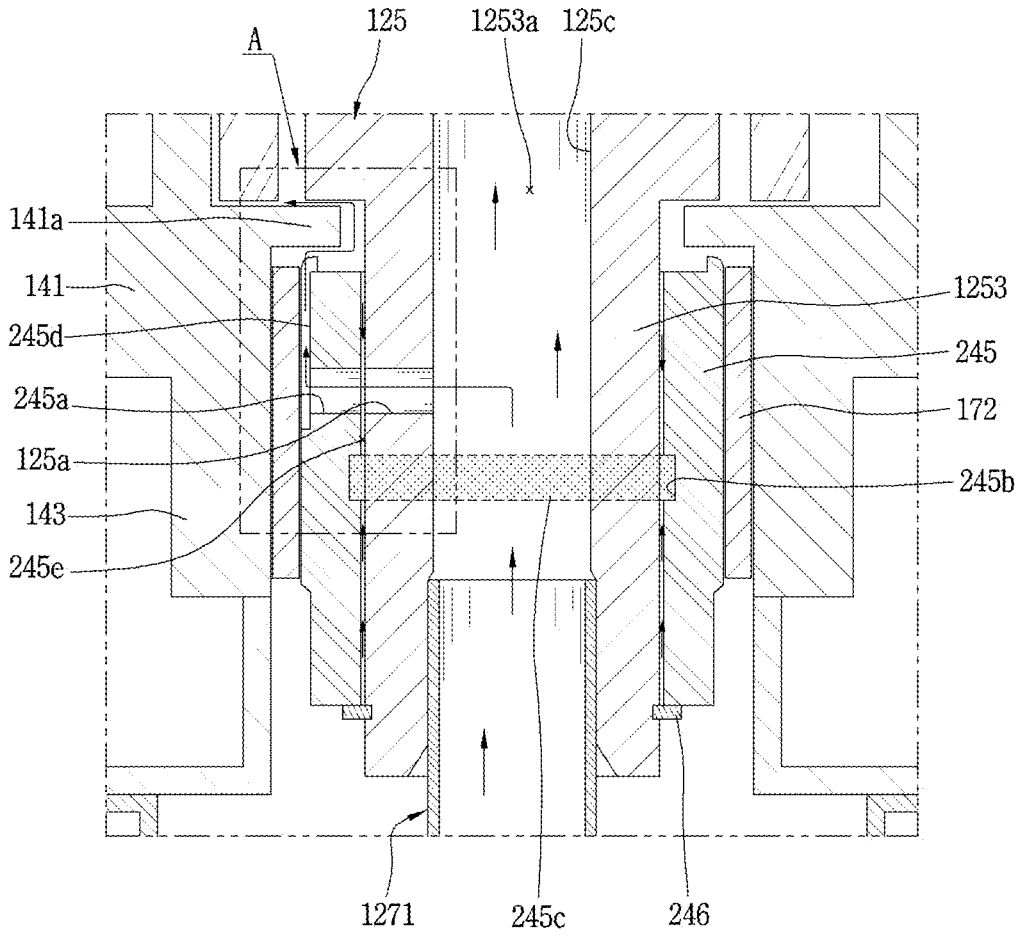
FIG. 4 is a cross-sectional view illustrating an example of a differential pressure oil supply through the bushing.
Figure 5:
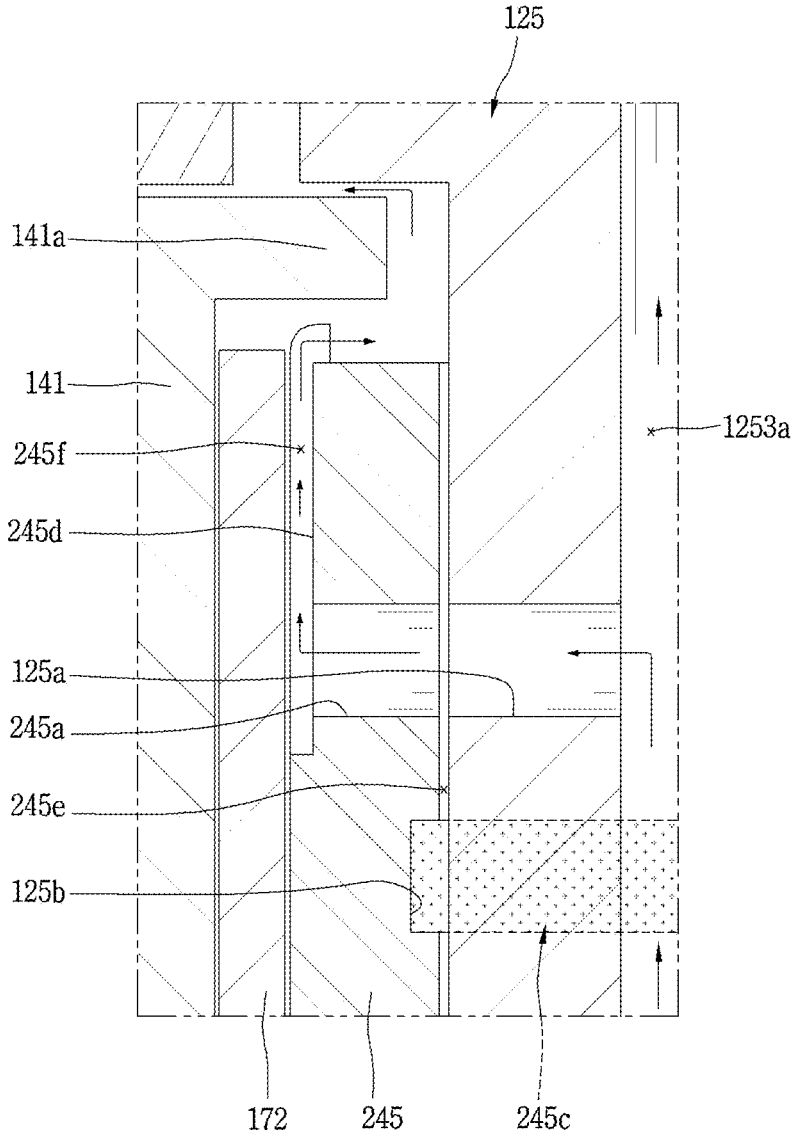
FIG. 5 is a cross-sectional view illustrating a part A in FIG. 4.

FIG. 1 is a cross-sectional view illustrating a scroll compressor 20 according to the present disclosure, FIG. 2 is an exploded perspective view illustrating a rotation shaft 125, a bushing 245, and a fixed scroll 140 according to the present disclosure, and FIG. 3 is an exploded perspective view illustrating a part of FIG. 1. In addition, FIG. 4 is a cross-sectional view illustrating an example of causing a differential pressure oil supply through the bushing 245, and FIG. 5 is a cross-sectional view illustrating a part A in FIG. 4.

Hereinafter, a scroll compressor 20 according to the present disclosure will be described, with reference to FIGS. 1 to 5.

The scroll compressor 20 according to the present disclosure includes: a casing 110 defining appearance; an electromotive part 120 installed inside the casing 110 to generate driving force; a compression part including a rotation shaft 125 rotatably installed on the electromotive part 120, an orbiting scroll 150 installed to be orbital with respect to the rotation shaft 125, and a fixed scroll 140 engaged with the orbiting scroll 150 to form a compression chamber V together with the orbiting scroll 150; and a bushing 245 disposed between the compression part and the rotation shaft 125 and coupled to an outer circumference of the rotation shaft 125 to rotate together with the rotation shaft 125. The bushing 245 is supported by one surface disposed inside the fixed scroll 140.

Accordingly, the scroll compressor 20 according to the present disclosure can reduce internal leakage and an increase in friction loss by virtue of the bushing 245, thereby reducing efficiency deterioration of the compressor or an occurrence of dispersion associated with the efficiency deterioration.

In the case where the bushing 245 is directly coupled to an inner circumference of the fixed scroll 140 without a fixed bearing 172 to be described later, the bushing 245 may also perform even a function of a bearing between the fixed scroll 140 and the rotation shaft 125.

The scroll compressor 20 according to the present disclosure may be a shaft-through scroll compressor 10 in which the rotation shaft 125 is disposed to penetrate the orbiting scroll 150 and the fixed scroll 140. As illustrated in FIG. 1, the scroll compressor 20 can be understood as a "shaft-through scroll compressor" in which the rotation shaft 125 is disposed to penetrate the compression part including the orbiting scroll 150 and the fixed scroll 140.

In the present disclosure, the bushing 245 may be arranged concentrically so that its center is aligned with a center of the rotation shaft 125 installed on an inner circumference of the bushing 245. In addition, the bushing 245 may be arranged concentrically such that its center is aligned with a center of the fixed bearing 172 or fixed scroll 140 installed on an outer circumference of the bushing 245. In this way, the bushing 245 according to the present disclosure can be understood as a concentric bushing.

The scroll compressor 20 according to the present disclosure may further include a fixed bearing 172. The fixed bearing 172 may be disposed between the fixed scroll 140 and the bushing 245, and may be inserted and coupled to an inner circumference of the fixed scroll 140 in a fitting manner. The bushing 245 may supported on an inner surface of the fixed bearing 172.

The bushing 245 may rotate with the rotation shaft 125 while slidably rotating relative to the fixed bearing 172.

According to the present disclosure, the bushing 245 can be fitted to the inner circumference of the fixed bearing 172, so that surface pressure of the fixed bearing 172 of the fixed scroll 140 can be reduced at a portion where the bushing 245 is installed, and size expansion or sufficient area of the fixed bearing 172 of the fixed scroll 140 can be secured. In particular, the use of the bushing 245 can derive the effect of increasing the diameter of the fixed bearing 172 without changing the major dimensions of the fixed bearing 172 or the fixed scroll 140.

The bushing 245 may include an oil supply hole **245*a* through which inside and outside of the bushing 245 can communicate with each other. Additionally, the rotation shaft 125 may be provided with an oil supply opening 125*a* formed to communicate with the oil supply hole 245*a*. The oil supply hole 245*a* may be formed radially toward the center of the bushing 245. In addition, the oil supply opening 125*a* may be formed radially toward the center of the rotation shaft 125**.

An oil groove 245*b* may be formed in the inner circumference of the bushing 245 or the outer circumference of the rotation shaft 125. The oil groove 245*b* may be formed in a circumferential direction. As the oil groove 245*b* is provided in the inner circumference of the bushing 245 or the outer circumference of the rotation shaft 125, oil in the oil storage space is suctioned upward through the oil supply hole of the rotation shaft 125 and flows through the oil supply opening 125*a* of the rotation shaft 125, to be received in the oil groove 245*b*. In this state, the oil can form an oil film 245*c*.

When the bushing 245 is coupled the rotation shaft 125 in an inserting manner, a gap of several μm to several tens of μm is generated between the bushing 245 and the rotation shaft 125. When refrigerant enters or exits the compression part through this gap, the function of differential pressure oil supply is deteriorated or a differential pressure oil supply does not work. This makes it difficult to supply oil into the compression part, thereby lowering efficiency or reliability of the compressor.

In particular, if refrigerant leaks through the gap between the bushing 245 and the rotation shaft 125, a one-way oil supply path by a differential pressure oil supply is open, causing the differential pressure to be broken or lowered, and the oil supply to the compression part to be failed.

As the oil groove 245*b* is formed in the inner circumference of the bushing 245 or the outer circumference of the rotation shaft 125, oil flows into the oil groove 245*b* in the circumferential direction, and as the rotation shaft 125 rotates, the oil forms an oil film within the oil groove 245*b* by centrifugal force, so that an oil film 245*c* is formed in the circumferential direction between the rotation shaft 125 and the bushing 245. The gap between the rotation shaft 125 and the bushing 245 is sealed by the oil film 245*c*, thereby suppressing leakage of refrigerant between the rotation shaft 125 and the bushing 245.

Meanwhile, an oil supply hole 125*c* may be formed in the rotation shaft 125 to communicate with an internal oil passage 1261, such that oil moves upward along the internal oil passage 1261. For example, the oil supply hole 125*c* may be formed to guide oil to a first bearing portion 1252, a fixed bearing portion 1253, and an eccentric portion 1254 of the rotation shaft 125. The oil supply hole 125*c* may be formed through each of the first bearing portion 1252, the fixed bearing portion 1253, and the eccentric portion 1254 of the rotation shaft 125 in a connected form.

Referring to FIGS. 4 and 5, an example is shown in which oil suctioned along the oil supply hole 125*c* of the fixed bearing 172 of the rotation shaft 125 flows radially along the oil supply opening 125*a* of the rotation shaft 125, flows toward the fixed bearing 172 through the oil supply hole 245*a* of the bushing 245, and is supplied to the fixed scroll 140. As the rotation shaft 125 rotates, force acts on the oil in the radial direction, such that the oil is supplied to the fixed scroll 140 via the fixed bearing 172 along the oil supply opening 125*a* of the rotation shaft 125.

In addition, in FIGS. 4 and 5, the oil groove 245*b* is formed in the inner circumference of the bushing 245. Oil flowing through the oil supply opening 125*a* of the rotation shaft 125 and oil flowing along the bushing 245 and the outer circumferential surface of the rotation shaft 125 are accommodated in the oil groove 245*b* formed in the inner circumference of the bushing 245, and affected by centrifugal force applied by the rotation of the rotation shaft 125 in the circumferential direction, thereby forming a sealing structure. The sealing structure formed by the force acting in the circumferential direction may be understood as the oil film 245*c* or an oil wall, which blocks the movement of refrigerant. In the present disclosure, it is mainly described as the oil film 245*c*, but may also be named the oil wall.

In FIG. 3, an example is shown in which one oil supply opening 125*a* is formed to intersect radially with the oil supply hole 125*c* of the rotation shaft 125, the oil groove 245*b* is formed in the inner circumference of the bushing 245, and the oil groove 245*b* in the inner circumference of the bushing 245 is disposed to be spaced downwardly apart from the oil supply opening 125*a* below. However, it is not necessarily limited to this structure and can be implemented in various embodiments as described below. That is, at least one oil supply opening 125*a* may be formed, the oil groove 245*b* may be disposed above the oil supply opening 125*a*, or the oil groove 245*b* may be formed at the same height as the oil supply opening 125*a*.

A passage groove 245*d* may be formed in the outer circumference of the bushing 245 to communicate with the oil supply hole 245*a*. The passage groove 245*d* may be formed axially in the outer circumference of the bushing 245 and may serve as a passage for guiding oil that has passed through the oil supply hole 245*a* toward the fixed scroll 140. Referring to FIGS. 2 to 5, the passage groove 245*d* is formed upward at a position where the oil supply hole 245*a* is disposed. In addition, an example is shown in which the passage groove 245*d* is formed concavely by a predetermined width in the radial direction.

For example, the oil supply hole 245*a* is accommodated inside the passage groove 245*d*. In addition, the passage groove 245*d* may be formed up to the top of the bushing 245, so that oil passing through the oil supply hole 245*a* can be guided to the top of the bushing 245.

Hereinafter, the structure of the oil groove 245*b*, as a configuration that enables the formation of the oil film 245*c* blocking the flow of refrigerant, will be described in more detail.

The oil groove 245*b* may be spaced downwardly apart from the oil supply hole 245*a* or the oil supply opening 125*a*.

With the configuration, the oil film 245*c* can be formed between the oil groove 245*b* and the oil supply hole 245*a* or the oil supply opening 125*a* below the position where the oil supply hole 245*a* or the oil supply opening 125*a* is formed, thereby blocking the flow of refrigerant while securing a distance from the oil supply hole 245*a* or the oil supply opening 125*a*.

In addition, the oil groove 245*b* may be spaced upwardly apart from the oil supply hole 245*a* or the oil supply opening 125*a*.

With the configuration, the oil film 245*c* can be formed between the oil groove 245*b* and the oil supply hole 245*a* or the oil supply opening 125*a* above the position where the oil supply hole 245*a* or the oil supply opening 125*a* is formed, thereby blocking the flow of refrigerant while securing a distance from the oil supply hole 245*a* or the oil supply opening 125*a*.

In addition, at least one oil groove 245*b* may be provided. In the case where two or more oil grooves 245*b* are formed, the two or more oil grooves 245*b* may be disposed to be spaced apart from each other to maximize the refrigerant blocking effect of the oil film 245*c*.

The oil groove 245*b* may be formed to communicate with the oil supply hole 245*a* or the oil supply opening 125*a* without being spaced apart from the oil supply hole 245*a* or the oil supply opening 125*a*.

It can be understood that the oil groove 245*b* is formed to communicate with the oil supply hole 245*a* in the case where the oil groove 245*b* is formed in the inner circumference of the bushing 245, and the oil groove 245*b* is formed to communicate with the oil supply opening 125*a* in the case where the oil groove 245*b* is formed in the outer circumference of the rotation shaft 125.

Alternatively, the oil grooves 245*b* may be disposed to be spaced apart from both bottom and top of the oil supply hole 245*a* or the oil supply opening 125*a*. At this time, at least one oil groove 245*b* may be disposed at each of the bottom and top of the oil supply hole 245*a* or the oil supply opening 125*a*.

As illustrated by the arrows in FIGS. 4 and 5, oil that has passed through the oil supply opening 125*a* may flow downward to be received in the oil groove 245*b*, oil that has passed through the oil supply opening 125*a* and the oil supply hole 245*a* may move upward and then flow downward between the bushing 245 and the outer circumference of the rotation shaft 125 to be accommodated in the oil groove 245*b*, or oil that has been located near the bottom of the oil groove 245*b* may rise to be accommodated in the oil groove 245*b*.

FIGS. 4 and 5 illustrate an example in which the oil film 245*c* is formed in a left-right direction below the oil supply hole 245*a* and the oil supply opening 125*a*. As oil, which is filled in the oil groove 245*b* formed in the outer circumference of the rotation shaft 125 or the inner circumference of the bushing 245 along the circumferential direction, is coherent with each other by receiving centrifugal force caused by the rotation of the rotation shaft 125, the oil film 245*c* is formed and serves as a wall for blocking the flow of refrigerant. Since the flow of refrigerant is blocked by the oil film 245*c*, the differential pressure oil supply system in the compression part can work normally without any problems.

Hereinafter, various embodiments in which the oil groove 245*b*, the oil supply hole 245*a*, and the oil supply opening 125*a* are formed will be described, with reference to FIGS. 6 to 13.

Figure 6:
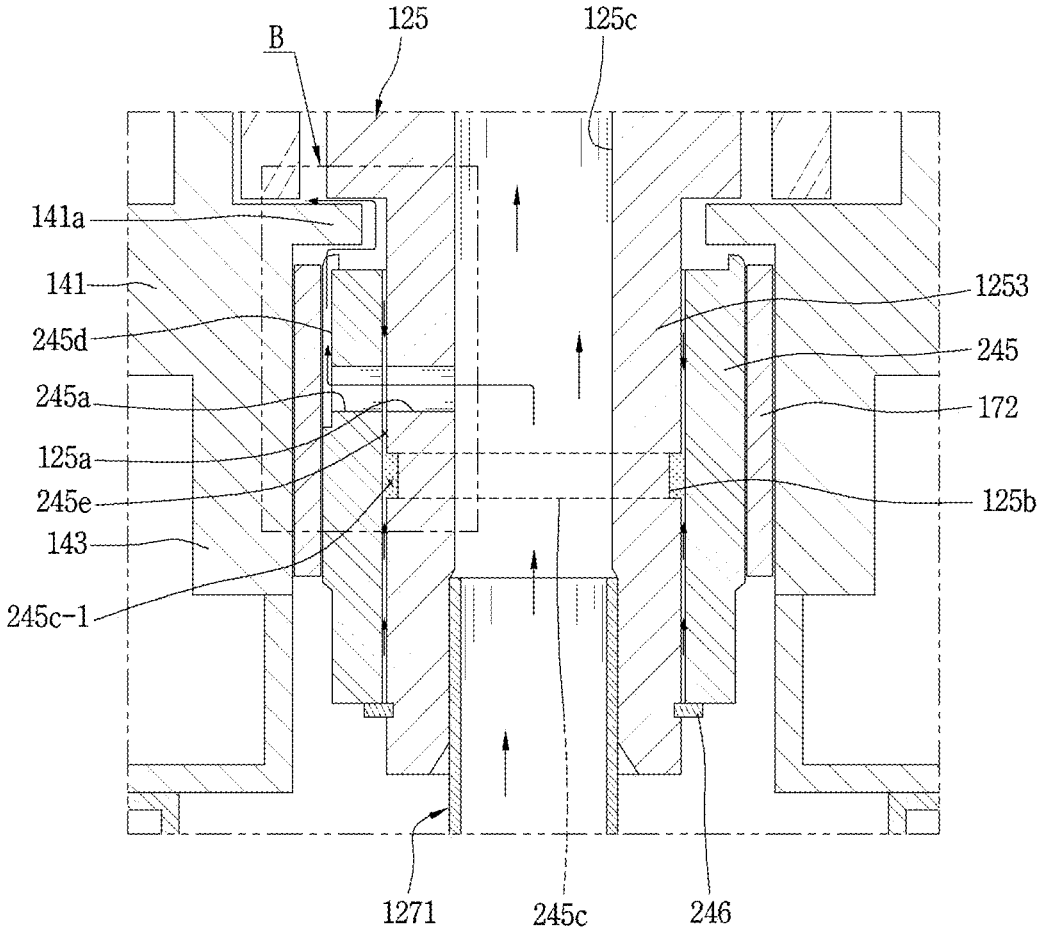
FIG. 6 is a cross-sectional view illustrating a first embodiment in which an oil groove is formed in an outer circumference of a rotation shaft below an oil supply opening.

In FIG. 6, an example is illustrated in which the oil groove 245*b* is formed in the outer circumference of the rotation shaft 125, the oil supply opening 125*a* is formed in the rotation shaft 125, and the oil supply hole 245*a* is formed in the bushing 245 to communicate with the oil supply opening 125*a* of the rotation shaft 125. Also, FIG. 7 is an enlarged cross-sectional view of a part B in FIG. 6.

Hereinafter, a first embodiment in which the oil supply hole 245*a*, the oil supply opening 125*a*, and the oil groove 245*b* are formed will be described with reference to FIGS. 6 and 7.

The oil supply opening 125*a* of the rotation shaft 125 and the oil supply hole 245*a* of the bushing 245 are disposed to be in communication with each other at the same height.

Figure 7:
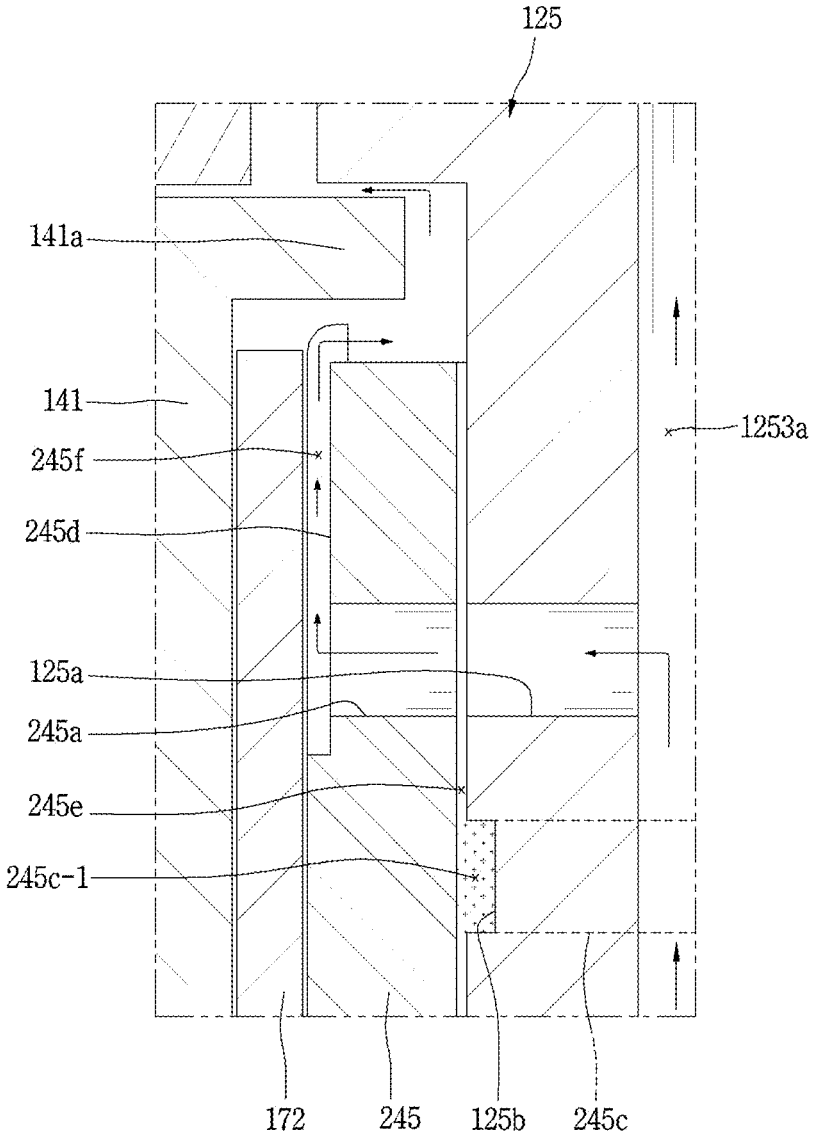
FIG. 7 is an enlarged cross-sectional view of a part B in FIG. 6.

In addition, FIGS. 6 and 7 illustrate an example in which the oil groove 245*b* in the outer circumference of the rotation shaft 125 is disposed lower than the oil supply opening 125*a* of the rotation shaft 125 and the oil supply hole 245*a* of the bushing 245.

With the configuration, oil suctioned through the oil supply hole 125*c* of the rotation shaft 125 is discharged to the outside of the bushing 245 through the oil supply opening 125*a* of the rotation shaft 125 and the oil supply hole 245*a* of the bushing 245 communicating with the oil supply opening 125*a*, flows upward along the outer circumference of the bushing 245, and is supplied to the fixed scroll 140. An example is illustrated in which oil flows while forming a passage curved plural times from the top of the bushing 245 along the bottom, side, and top of a sealing surface portion 141*a*.

Meanwhile, oil that has escaped through the oil supply opening 125*a* of the rotation shaft 125 flows downward between the inner circumference of the bushing 245 and the outer circumference of the rotation shaft 125 to be accommodated in the oil groove 245*b* formed in the outer circumference of the rotation shaft 125, and forms the oil film 245*c* in the circumferential direction by receiving the centrifugal force caused by the rotation of the rotation shaft 125, thereby forming the sealing structure.

A gap passage 245*e* which is a fine gap may be formed between the bushing 245 and the rotation shaft 125. The bushing 245 and the rotation shaft 125 are coupled in the insertion manner while maintaining the fine gap therebetween, and thus, as illustrated in FIG. 7, such a fine gap is formed. Oil that has passed through the oil supply opening 125*a* and the oil supply hole 245*a* flows around the bushing 245 and the rotation shaft 125, and then is filled in the oil groove 245*b* through the gap passage 245*e*, thereby forming the oil film 245*c*. The bushing 245 and the rotation shaft 125 are coupled to each other to be rotatable together, and a fine gap may be formed between the bushing 245 and the rotation shaft 125 so that oil can flow. The gap passage 245*e* may be understood as a fine gap through which oil can flow.

As oil, which is filled in the oil groove 245*b* formed in the outer circumference of the rotation shaft 125 or the inner circumference of the bushing 245 along the circumferential direction, coheres with each other by receiving centrifugal force caused by the rotation of the rotation shaft 125, the oil film 245*c* is formed and serves as a wall for blocking the flow of refrigerant. Since the flow of refrigerant is blocked by the oil film 245*c*, the differential pressure oil supply system in the compression part can work normally without any problems.

The oil groove 245*b* may be provided with an oil film forming portion 245*c*-1 formed in the circumferential direction together with the outer circumference of the rotation shaft 125 or the inner circumference of the bushing 245, so that oil is filled therein. When oil is filled in the oil film forming portion 245*c*-1, the oil film 245*c* is formed. FIG. 7 illustrates an example in which the oil film forming portion 245*c*-1 is disposed between the oil groove 245*b* in the outer circumference of the rotation shaft 125 and the inner circumference of the bushing 245. The oil film forming portion 245*c*-1 is formed in the circumferential direction between the oil groove 245*b* and the inner circumference of the bushing 245.

In another embodiment, the oil film forming portion 245*c*-1 may be formed adjacent to the oil groove 245*b* to be filled with oil.

In the compression part, the downward movement of refrigerant is blocked by the oil film 245*c* formed in the oil groove 245*b*.

When the oil groove 245*b* is formed in the outer circumference of the rotation shaft 125, the oil groove 245*b* is radially small, compared to the case where the oil groove 245*b* is formed in the inner circumference of the bushing 245. Therefore, the oil film 245*c* can be formed by a relatively small amount of oil.

Figure 8:
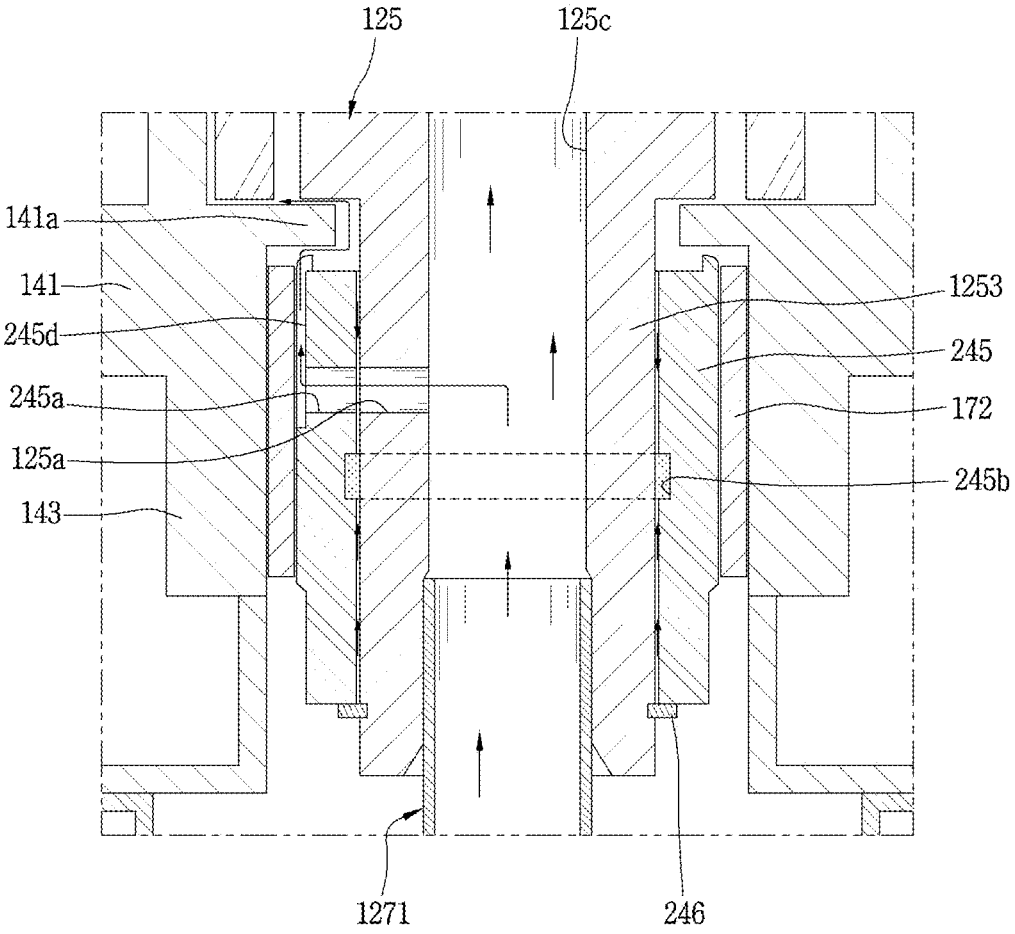
FIG. 8 is a cross-sectional view illustrating a second embodiment in which an oil groove is formed in an inner circumference of a bushing below an oil supply hole.

In FIG. 8, a second embodiment is illustrated in which the oil groove 245*b* is formed in the inner circumference of the bushing 245, the oil supply opening 125*a* is formed in the rotation shaft 125, and the oil supply hole 245*a* is formed in the bushing 245 to communicate with the oil supply opening 125*a* of the rotation shaft 125.

Hereinafter, the second embodiment in which the oil supply hole 245*a*, the oil supply opening 125*a*, and the oil groove 245*b* are formed will be described with reference to FIG. 8.

The oil supply opening 125*a* of the rotation shaft 125 and the oil supply hole 245*a* of the bushing 245 are disposed to be in communication with each other at the same height.

In addition, FIG. 8 illustrates an example in which the oil groove 245*b* in the inner circumference of the bushing 245 is located lower than the oil supply opening 125*a* of the rotation shaft 125 and the oil supply hole 245*a* of the bushing 245.

With the configuration, oil suctioned through the oil supply hole 125*c* of the rotation shaft 125 is supplied to the fixed scroll 140 through the oil supply opening 125*a* of the rotation shaft 125 and the oil supply hole 245*a* of the bushing 245 communicating with the oil supply opening 125*a*. The oil supply hole 125*c* is provided with an oil flow passage 1253*a* through which oil is suctioned.

In addition, oil that has escaped through the oil supply opening 125*a* of the rotation shaft 125 flows downward between the inner circumference of the bushing 245 and the outer circumference of the rotation shaft 125 to be accommodated in the oil groove 245*b* formed in the inner circumference of the bushing 245, and forms the oil film 245*c* in the circumferential direction by receiving the centrifugal force caused by the rotation of the rotation shaft 125, thereby forming the sealing structure.

A gap passage 245*e* which is a fine gap may be formed between the bushing 245 and the rotation shaft 125. The bushing 245 and the rotation shaft 125 are coupled in the insertion manner while maintaining a fine gap therebetween, and thus, as illustrated in FIG. 8, such a fine gap is formed. Oil that has passed through the oil supply opening 125*a* and the oil supply hole 245*a* flows around the bushing 245 and the rotation shaft 125, and then is filled in the oil groove 245*b* through the gap passage 245*e*, thereby forming the oil film 245*c*. The bushing 245 and the rotation shaft 125 are coupled to each other to be rotatable together, and a fine gap may be formed between the bushing 245 and the rotation shaft 125 so that oil can flow.

In the compression part, the downward movement of refrigerant is blocked by the oil film 245*c* formed by the oil accommodated in the oil groove 245*b*.

Figure 9:
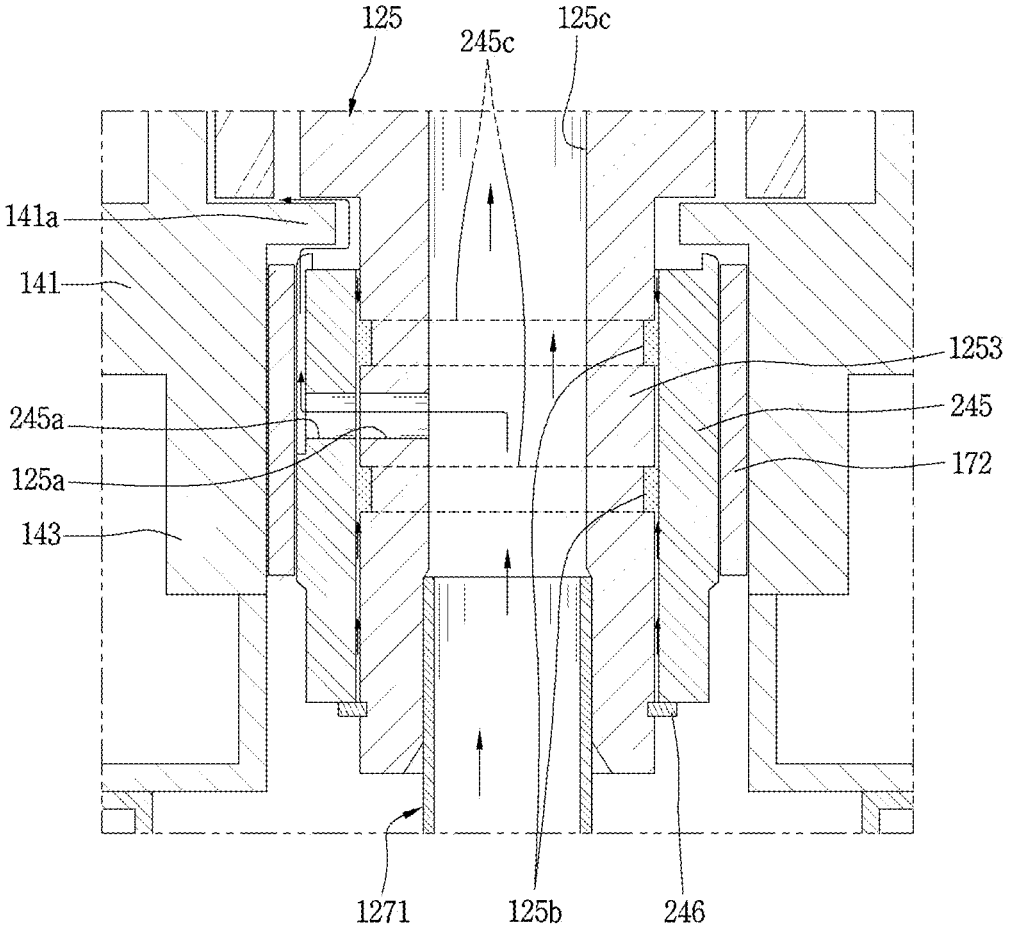
FIG. 9 is a cross-sectional view illustrating a third embodiment in which oil grooves are formed in an outer circumference of a rotation shaft above and below an oil supply opening.

FIG. 9 illustrates an example in which the oil supply opening 125*a* is formed in the rotation shaft 125, the oil supply hole 245*a* is formed in the bushing 245 to communicate with the oil supply opening 125*a* of the rotation shaft 125, and the oil grooves 245*b* are formed above and below the oil supply opening 125*a* in the outer circumference of the rotation shaft 125.

Hereinafter, the third embodiment in which the oil supply hole 245*a*, the oil supply opening 125*a*, and the oil grooves 245*b* are formed will be described with reference to FIG. 9.

The oil supply opening 125*a* of the rotation shaft 125 and the oil supply hole 245*a* of the bushing 245 are disposed to be in communication with each other at the same height.

In addition, FIG. 9 illustrates an example in which the oil grooves 245*b* in the outer circumference of the rotation shaft 125 are disposed above and below the oil supply opening 125*a* of the rotation shaft 125 and the oil supply hole 245*a* of the bushing 245, respectively.

With the configuration, oil suctioned through the oil supply hole 125*c* of the rotation shaft 125 is supplied to the fixed scroll 140 through the oil supply opening 125*a* of the rotation shaft 125 and the oil supply hole 245*a* of the bushing 245 communicating with the oil supply opening 125*a*. The oil supply hole 125*c* is provided with an oil flow passage 1253*a* through which oil is suctioned.

In addition, oil that has escaped through the oil supply opening 125*a* of the rotation shaft 125 flows downward and upward between the inner circumference of the bushing 245 and the outer circumference of the rotation shaft 125 to be accommodated in the oil grooves 245*b* formed in the outer circumference of the rotation shaft 125, and forms the oil film 245*c* in the circumferential direction by receiving the centrifugal force caused by the rotation of the rotation shaft 125, thereby forming the sealing structure.

In the compression part, the downward and upward movements of refrigerant are blocked by the oil film 245*c* formed in the oil groove 245*b*.

In the third embodiment, when the oil grooves 245*b* are formed in the outer circumference of the rotation shaft 125, the oil film 245*c* is radially small, compared to the case where the oil groove 245*b* is formed in the inner circumference of the bushing 245. Therefore, the oil film 245*c* can be formed by a relatively small amount of oil.

Figure 10:
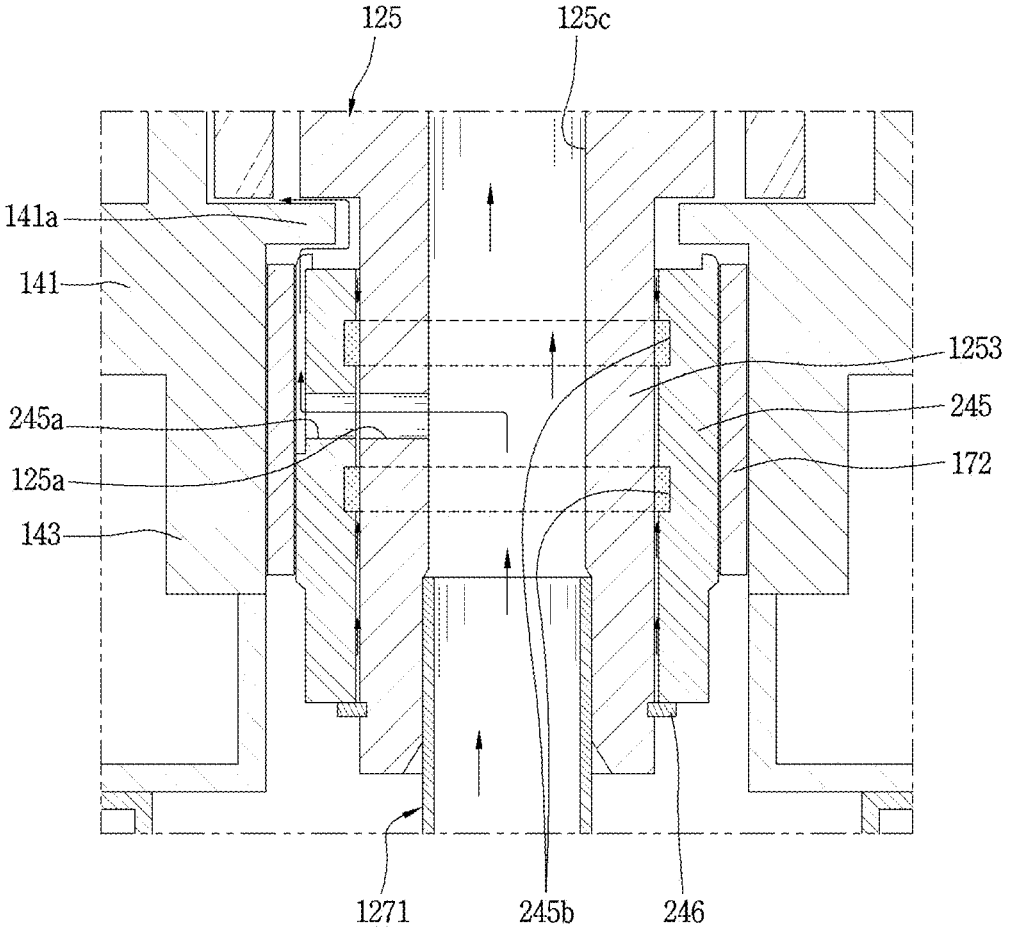
FIG. 10 is a cross-sectional view illustrating a fourth embodiment in which oil grooves are formed in an inner circumference of a bushing above and below an oil supply hole.

FIG. 10 illustrates a fourth embodiment in which the oil supply opening 125*a* is formed in the rotation shaft 125, the oil supply hole 245*a* is formed in the bushing 245 to communicate with the oil supply opening 125*a* of the rotation shaft 125, and the oil grooves 245*b* are formed in the inner circumference of the bushing 245 above and below the oil supply opening 125*a* and the oil supply hole 245*a*, respectively.

Hereinafter, the fourth embodiment in which the oil supply hole 245*a*, the oil supply opening 125*a*, and the oil grooves 245*b* are formed will be described with reference to FIG. 10.

The oil supply opening 125*a* of the rotation shaft 125 and the oil supply hole 245*a* of the bushing 245 are disposed to be in communication with each other at the same height.

In addition, FIG. 10 illustrates an example in which the oil grooves 245*b* in the inner circumference of the bushing 245 are disposed above and below the oil supply opening 125*a* of the rotation shaft 125 and the oil supply hole 245*a* of the bushing 245, respectively.

With the configuration, oil suctioned through the oil supply hole 125*c* of the rotation shaft 125 is supplied to the fixed scroll 140 through the oil supply opening 125*a* of the rotation shaft 125 and the oil supply hole 245*a* of the bushing 245 communicating with the oil supply opening 125*a*.

The oil supply hole 125*c* is provided with an oil flow passage 1253*a* through which oil is suctioned.

In addition, oil that has escaped through the oil supply opening 125*a* of the rotation shaft 125 flows downward and upward between the inner circumference of the bushing 245 and the outer circumference of the rotation shaft 125 to be accommodated in the oil grooves 245*b* formed in the inner circumference of the bushing 245, and forms the oil film 245*c* in the circumferential direction by receiving the centrifugal force caused by the rotation of the rotation shaft 125, thereby forming the sealing structure.

In the compression part, the downward and upward movements of refrigerant are blocked by the oil film 245*c* formed by oil accommodated in the oil grooves 245*b*.

Figure 11:
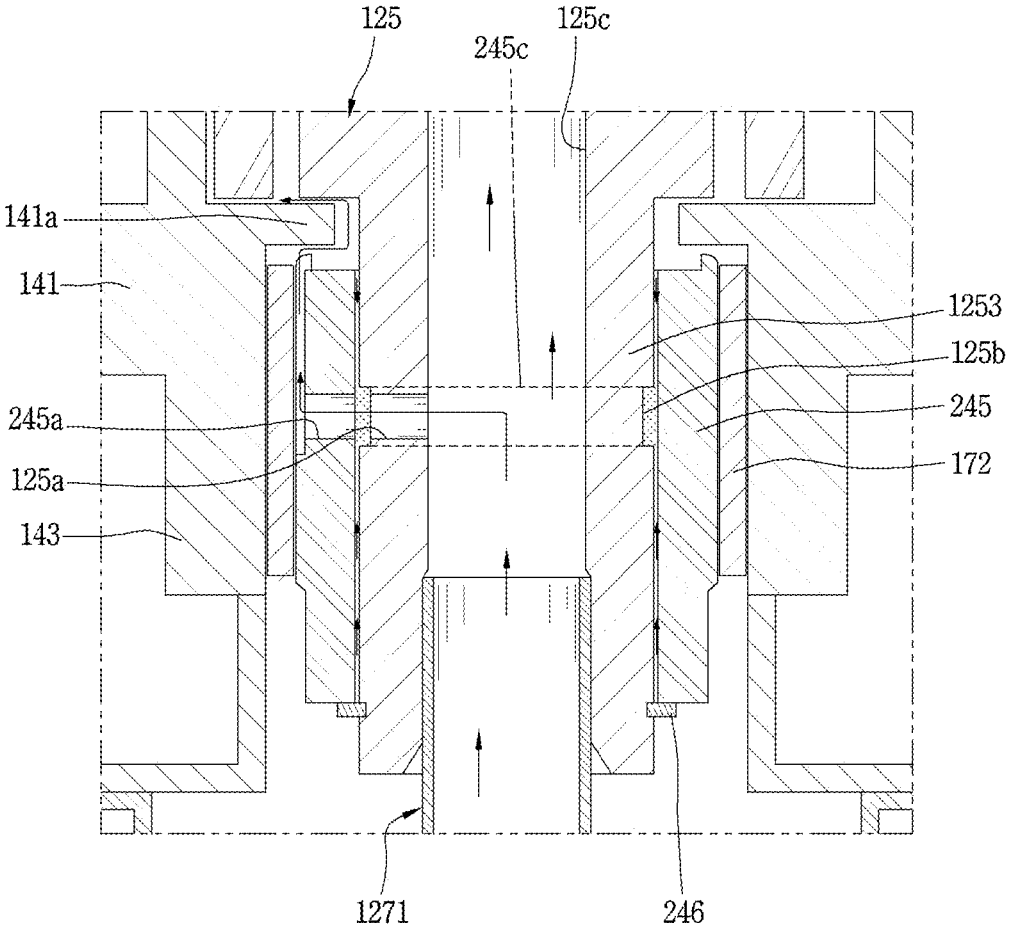
FIG. 11 is a cross-sectional view illustrating a fifth embodiment in which an oil groove is formed in an outer circumference of a rotation shaft to communicate with an oil supply opening.

FIG. 11 illustrates an example in which the oil supply opening 125*a* is formed in the rotation shaft 125, the oil supply hole 245*a* is formed in the bushing 245 to communicate with the oil supply opening 125*a* of the rotation shaft 125, and the oil groove 245*b* is formed in the outer circumference of the rotation shaft 125 at a position where it communicates with the oil supply opening 125*a*.

Hereinafter, the fifth embodiment in which the oil supply hole 245*a*, the oil supply opening 125*a*, and the oil groove 245*b* are formed will be described with reference to FIG. 11.

The oil supply opening 125*a* of the rotation shaft 125 and the oil supply hole 245*a* of the bushing 245 are disposed to be in communication with each other at the same height.

In addition, an example in which the oil groove 245*b* in the outer circumference of the rotation shaft 125 is arranged to communicate with the oil supply opening 125*a* of the rotation shaft 125 is shown in FIG. 11. That is, the oil supply opening 125*a* is formed at a position overlapping the oil groove 245*b*.

With the configuration, oil suctioned from the oil flow passage 1253*a* of the rotation shaft 125 through the oil supply hole 125*c* of the rotation shaft 125 is supplied to the fixed scroll 140 through the oil supply opening 125*a* of the rotation shaft 125 and the oil supply hole 245*a* of the bushing 245 communicating with the oil supply opening 125*a*.

In addition, oil that has escaped through the oil supply opening 125*a* of the rotation shaft 125 is accommodated in the oil groove 245*b* formed in the outer circumference of the rotation shaft 125 without flowing downward or upward between the inner circumference of the bushing 245 and the outer circumference of the rotation shaft 125, and forms the oil film 245*c* in the circumferential direction by receiving the centrifugal force caused by the rotation of the rotation shaft 125, thereby forming the sealing structure.

In the compression part, the downward movement of refrigerant is blocked by the oil film 245*c* formed in the oil groove 245*b*.

In the fifth embodiment, when the oil groove 245*b* is formed in the outer circumference of the rotation shaft 125, the oil film 245*c* is radially small, compared to the case where the oil groove 245*b* is formed in the inner circumference of the bushing 245. Therefore, the oil film 245*c* can be formed by a relatively small amount of oil.

Figure 12:
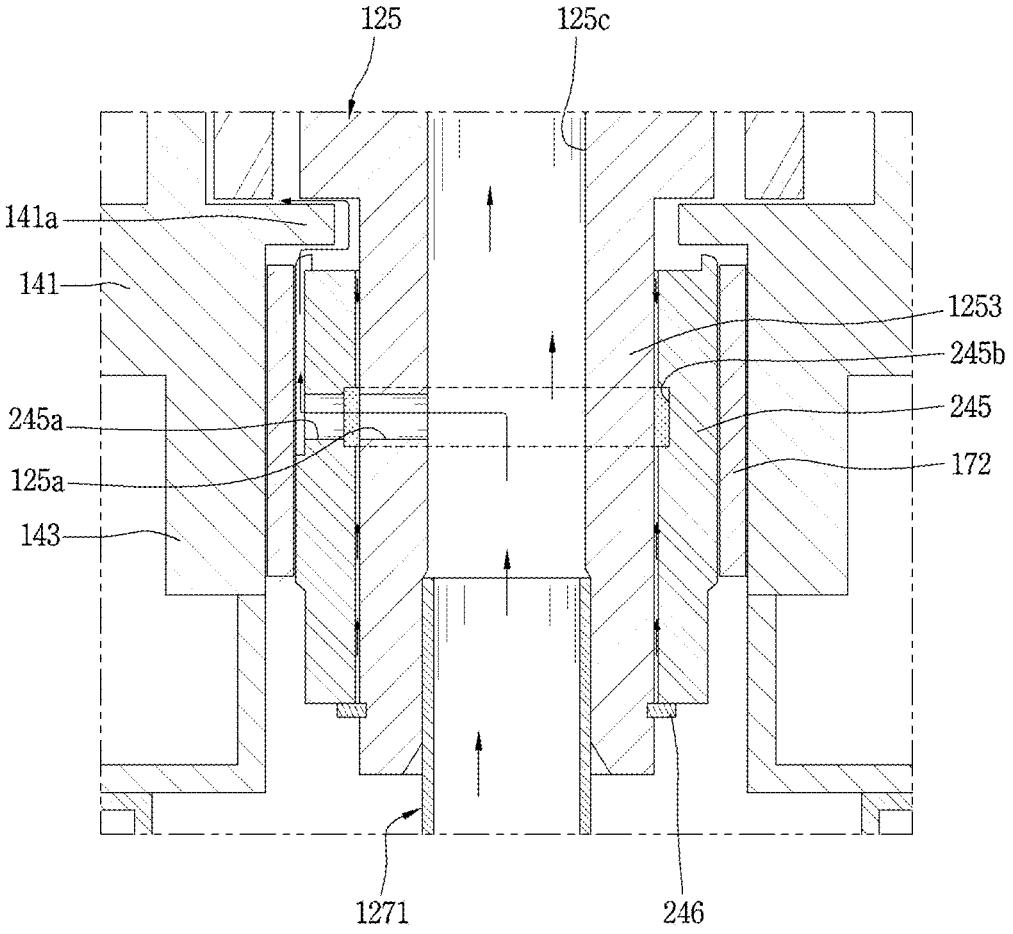
FIG. 12 is a cross-sectional view illustrating a sixth embodiment in which an oil groove is formed in an inner circumference of a bushing to communicate with an oil supply hole.

FIG. 12 illustrates an example in which the oil supply opening 125*a* is formed in the rotation shaft 125, the oil supply hole 245*a* is formed in the bushing 245 to communicate with the oil supply opening 125*a* of the rotation shaft 125, and the oil groove 245*b* is formed in the inner circumference of the bushing 245 at a position where it communicates with the oil supply hole 245*a*.

Hereinafter, the sixth embodiment in which the oil supply hole 245*a*, the oil supply opening 125*a*, and the oil groove 245*b* is formed will be described with reference to FIG. 11.

The oil supply opening 125*a* of the rotation shaft 125 and the oil supply hole 245*a* of the bushing 245 are disposed to be in communication with each other at the same height.

In addition, an example in which the oil groove 245*b* in the inner circumference of the bushing 245 is arranged to communicate with the oil supply hole 245*a* of the bushing 245 is shown in FIG. 11. That is, the oil supply hole 245*a* is formed at a position overlapping the oil groove 245*b*.

With the configuration, oil suctioned from the oil flow passage 1253*a* of the rotation shaft 125 through the oil supply hole 125*c* of the rotation shaft 125 is supplied to the fixed scroll 140 through the oil supply opening 125*a* of the rotation shaft 125 and the oil supply hole 245*a* of the bushing 245 communicating with the oil supply opening 125*a*.

In addition, oil that has escaped through the oil supply opening 125*a* of the rotation shaft 125 is accommodated directly in the oil groove 245*b* formed in the inner circumference of the bushing 245 without flowing downward or upward between the inner circumference of the bushing 245 and the outer circumference of the rotation shaft 125, and forms the oil film 245*c* in the circumferential direction by receiving the centrifugal force caused by the rotation of the rotation shaft 125, thereby forming the sealing structure.

In the compression part, the downward movement of refrigerant is blocked by the oil film 245*c* formed in the oil groove 245*b*.

Hereinafter, a seventh embodiment will be described with reference to FIG. 13.

The oil supply opening 125*a* of the rotation shaft 125 and the oil supply hole 245*a* of the bushing 245 are disposed to be in communication with each other at the same height.

Figure 13:
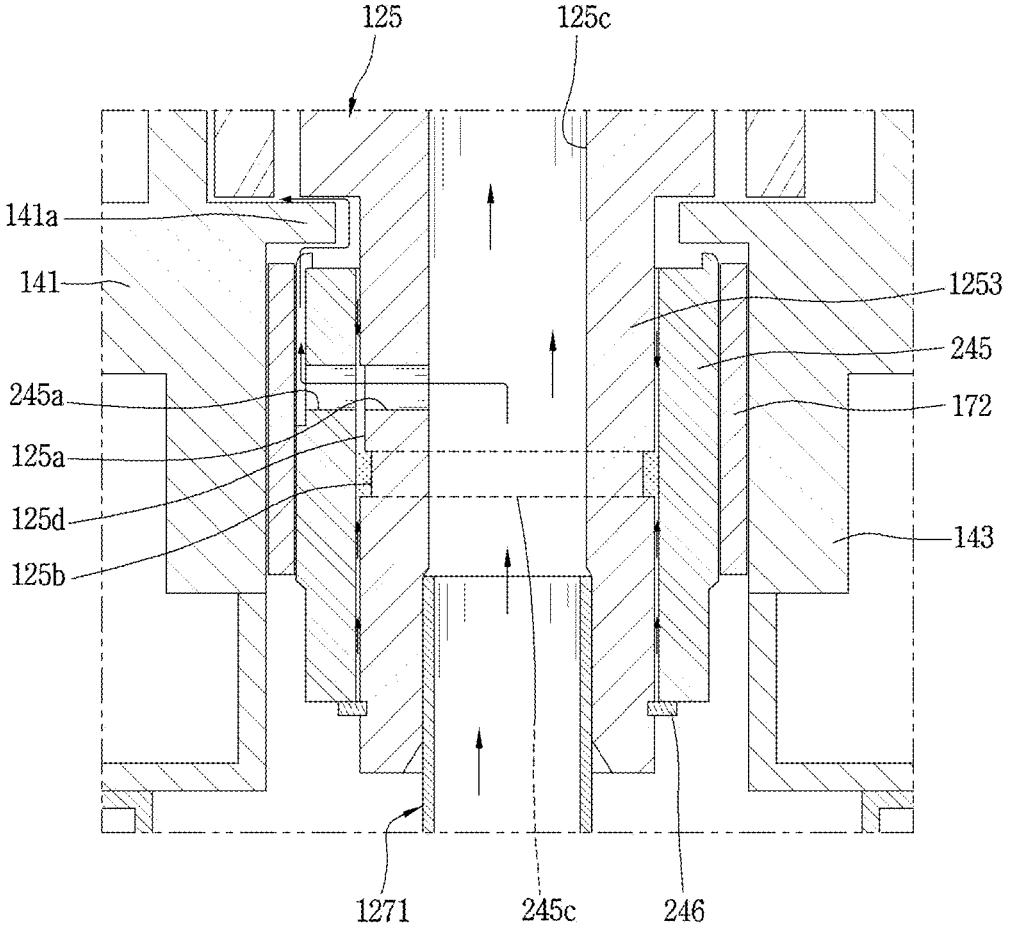
FIG. 13 is a cross-sectional view illustrating a seventh embodiment in which an oil groove is formed below an oil supply opening and formed in an outer circumference of a rotation shaft to communicate with the oil supply opening by a D-cut portion.

In addition, FIG. 13 illustrates an example in which the oil groove 245*b* in the outer circumference of the rotation shaft 125 is located lower than the oil supply opening 125*a* of the rotation shaft 125 and the oil supply hole 245*a* of the bushing 245.

With the configuration, oil suctioned through the oil supply hole 125*c* of the rotation shaft 125 is discharged to the outside of the bushing 245 through the oil supply opening 125*a* of the rotation shaft 125 and the oil supply hole 245*a* of the bushing 245 communicating with the oil supply opening 125*a*, flows along the outer circumference of the bushing 245, and is supplied to the fixed scroll 140. An example is illustrated in which oil flows while forming a passage curved plural times from the top of the bushing 245 along the bottom, side, and top of a sealing surface portion 141*a*.

Meanwhile, oil that has escaped through the oil supply opening 125*a* of the rotation shaft 125 flows downward between the inner circumference of the bushing 245 and the outer circumference of the rotation shaft 125 to be accommodated in the oil groove 245*b* formed in the outer circumference of the rotation shaft 125, and forms the oil film 245*c* in the circumferential direction by receiving the centrifugal force caused by the rotation of the rotation shaft 125, thereby forming the sealing structure.

As oil, which is filled in the oil groove 245*b* formed in the outer circumference of the rotation shaft 125 or the inner circumference of the bushing 245 along the circumferential direction, coheres with each other by receiving centrifugal force caused by the rotation of the rotation shaft 125, the oil film 245*c* is formed and serves as a wall for blocking the flow of refrigerant. Since the flow of refrigerant is blocked by the oil film 245*c*, the differential pressure oil supply system in the compression part can work normally without any problems.

In the compression part, the downward movement of refrigerant is blocked by the oil film 245*c* formed in the oil groove 245*b*.

When the oil groove 245*b* is formed in the outer circumference of the rotation shaft 125, the oil groove 245*b* is radially small, compared to the case where the oil groove 245*b* is formed in the inner circumference of the bushing 245. Therefore, the oil film 245*c* can be formed by a relatively small amount of oil.

The seventh embodiment of FIG. 13 is different from the previous embodiments in that a guide passage 125*d* is additionally provided. The guide passage 125*d* is formed in the vertical direction in FIG. 13 and is disposed between the oil supply opening 125*a* of the rotation shaft 125 and an oil supply groove. In addition, the guide passage 125*d* may have a structure that is radially recessed from the outer circumference of the rotation shaft 125. For example, the guide passage 125*d* may be formed in a D-cut structure between the oil supply opening 125*a* and the oil supply groove. Accordingly, in FIG. 13, the guide passage 125*d* is formed more inward than a distance from the center to the outer circumference of the rotation shaft 125.

FIG. 13 illustrates an example in which a radial width of the guide passage 125*d* is larger than a radial width of the oil groove 245*b*.

Hereinafter, an eighth embodiment will be described with reference to FIG. 14.

In the eighth embodiment, unlike the previous embodiments, the oil supply opening 125*a* of the rotation shaft 125 and the oil supply hole 245*a* of the bushing 245 are disposed at different heights.

In addition, the oil groove 245*b* in the outer circumference of the rotation shaft 125 is located lower than the oil supply hole 245*a* of the bushing 245, and is disposed to communicate with the oil supply opening 125*a* of the rotation shaft 125. For example, the center of the oil supply opening 125*a* may be located at the midpoint of the oil groove 245*b* in the vertical direction, but is not necessarily limited thereto.

In the eighth embodiment, the guide passage 125*d* is further provided as in the seventh embodiment. The guide passage 125*d* is formed in the vertical direction in FIG. 14, and is disposed between the outer circumference of the rotation shaft 125 that comes in contact with the top of the oil supply hole 245*a* of the bushing 245 and the top of the oil supply groove of the rotation shaft 125. In addition, the guide passage 125*d* may have a structure that is radially recessed from the outer circumference of the rotation shaft 125. For example, the guide passage 125*d* may be formed in a D-cut structure between the oil supply opening 125*a* and the oil supply groove. Accordingly, in FIG. 14, the guide passage 125*d* is formed more inward than a distance from the center to the outer circumference of the rotation shaft 125.

Figure 14:
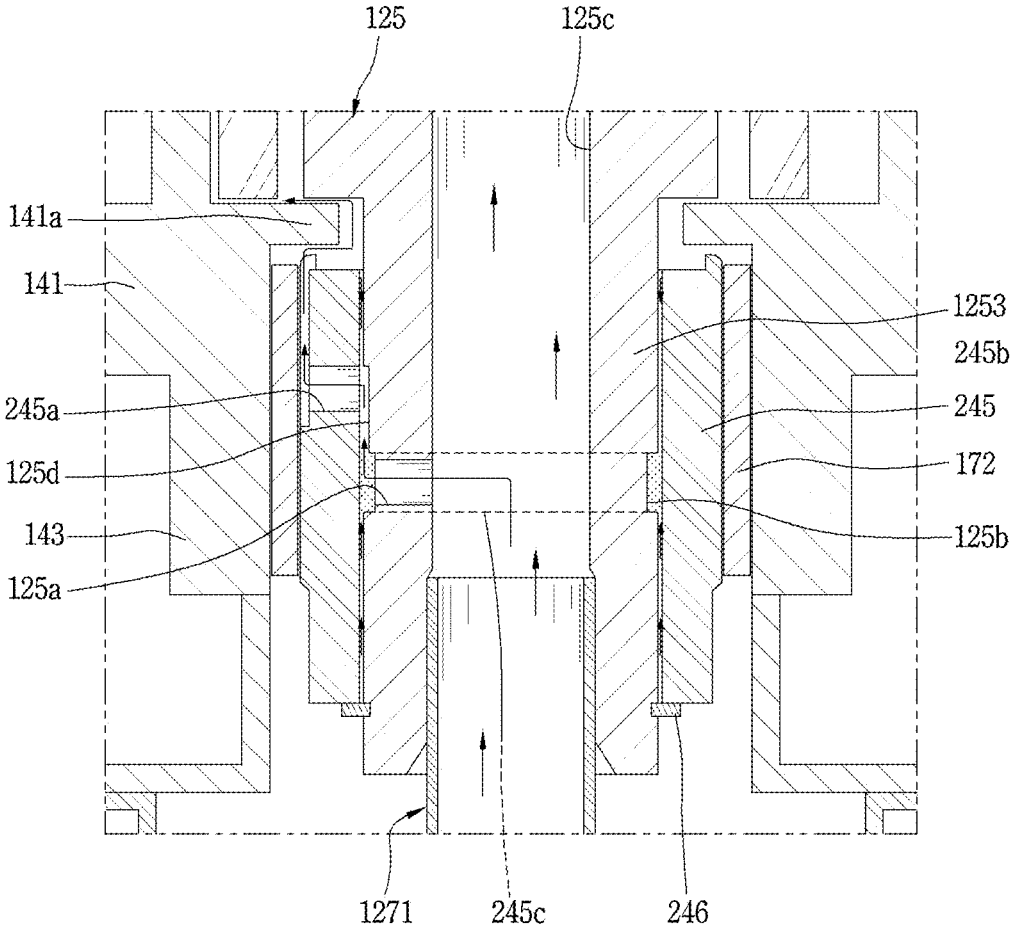
FIG. 14 is a cross-sectional view illustrating an eighth embodiment in which an oil groove is formed in an outer circumference of a rotation shaft to communicate with an oil supply opening, and communicates by a D-cut portion to supply oil to a bushing.

FIG. 14 illustrates an example in which a radial width of the guide passage is larger than a radial width of the oil groove 245*b*. In addition, the guide passage is disposed below the oil supply opening 125*a* of the rotation shaft 125 in the seventh embodiment, but in the eighth embodiment, the guide passage is disposed above the oil supply opening 125*a* of the rotation shaft 125, which is in the opposite direction to that in the seventh embodiment.

Accordingly, oil suctioned through the oil supply hole 125*c* of the rotation shaft 125 is discharged to the outer circumference of the rotation shaft 125 through the oil supply opening 125*a* of the rotation shaft 125 and then flows upward along the guide passage. Afterwards, the oil is discharged to the outside of the bushing 245 through the oil supply hole 245*a* of the bushing 245, flows upward along the outer circumference of the bushing 245, and is supplied to the fixed scroll 140. An example is illustrated in which oil introduced into the fixed scroll 140 flows while forming a passage curved plural times from the top of the bushing 245 along the bottom, side, and top of a sealing surface portion 141*a*.

Meanwhile, oil that has escaped through the oil supply opening 125*a* of the rotation shaft 125 flows downward between the inner circumference of the bushing 245 and the outer circumference of the rotation shaft 125 to be accommodated in the oil groove 245*b* formed in the outer circumference of the rotation shaft 125, and forms the oil film 245*c* in the circumferential direction by receiving the centrifugal force caused by the rotation of the rotation shaft 125, thereby forming the sealing structure.

As oil, which is filled in the oil groove 245*b* formed in the outer circumference of the rotation shaft 125 or the inner circumference of the bushing 245 along the circumferential direction, coheres with each other by receiving centrifugal force caused by the rotation of the rotation shaft 125, the oil film 245*c* is formed and serves as a wall for blocking the flow of refrigerant. Since the flow of refrigerant is blocked by the oil film 245*c*, the differential pressure oil supply system in the compression part can work normally without any problems.

In the compression part, the downward movement of refrigerant is blocked by the oil film 245*c* formed in the oil groove 245*b*.

When the oil groove 245*b* is formed in the outer circumference of the rotation shaft 125, the oil groove 245*b* is radially small, compared to the case where the oil groove 245*b* is formed in the inner circumference of the bushing 245. Therefore, the oil film 245*c* can be formed by a relatively small amount of oil.

In this way, according to various embodiments, since refrigerant leakage due to a gap between newly added components is suppressed by the concentric bushing structure, the differential pressure oil supply system in the compression part can work normally without problems.

In addition, the diameter of the bearing of the fixed scroll 140 can be expanded by the application of the bushing 245. Accordingly, surface pressure can be lowered, a load-bearing capacity can be increased, and thus the Sommerfeld number can be increased, resulting in improving reliability.

Hereinafter, another example of a scroll compressor 10 according to the present disclosure will be described with reference to FIG. 15.

Figure 15:
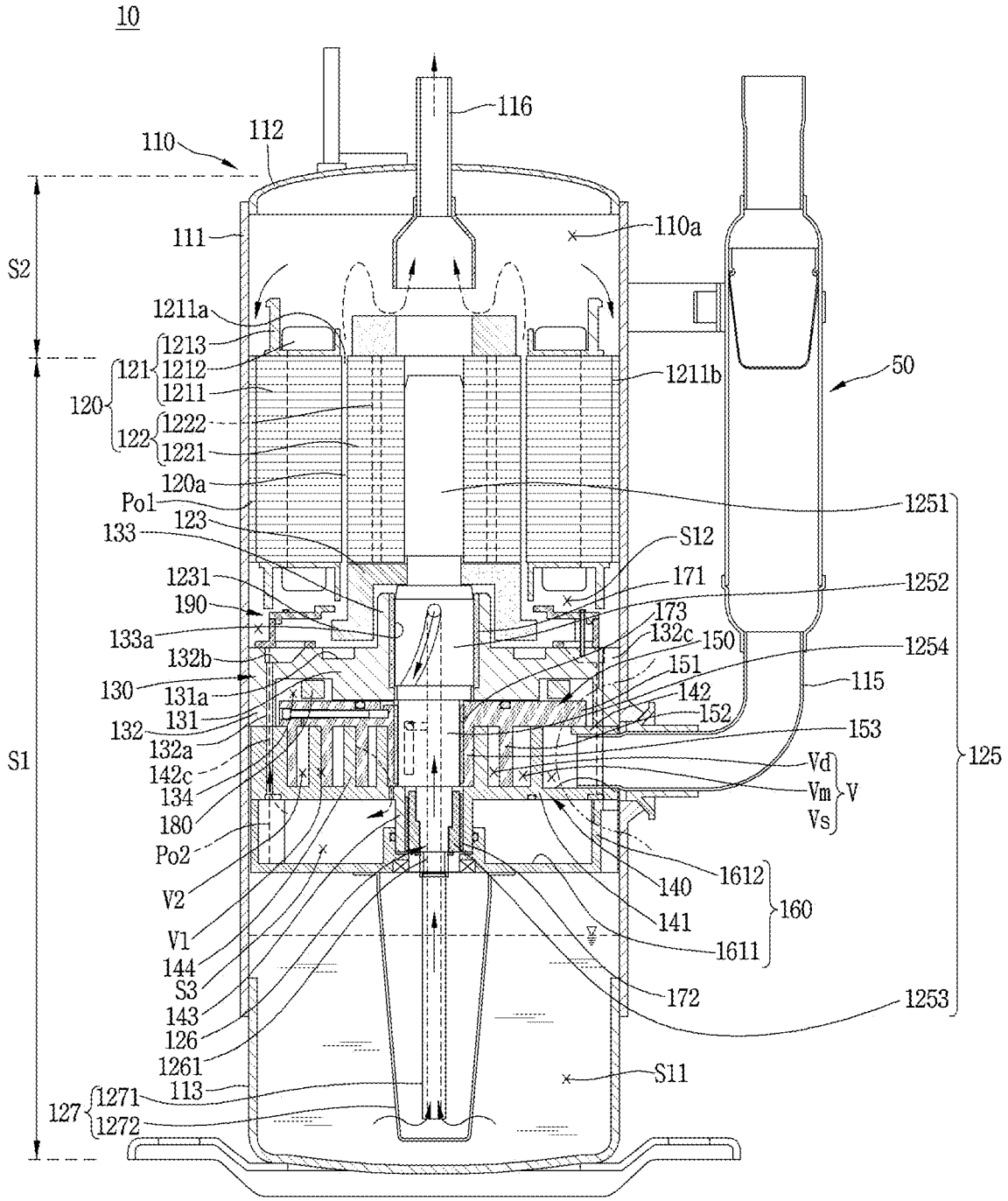
FIG. 15 is a cross-sectional view illustrating another example of a scroll compressor according to the present disclosure.

FIG. 15 is a sectional view illustrating a scroll compressor according to the present disclosure.

Hereinafter, a structure of a scroll compressor 10 according to the present disclosure will be described, with reference to FIG. 15.

The scroll compressor 10 according to the present disclosure includes: a casing 110 defining appearance; an electromotive part 120 installed inside the casing 110 to generate driving force; a compression part including a rotation shaft 125 rotatably installed on the electromotive part 120, an orbiting scroll 150 installed to be orbital with respect to the rotation shaft 125, and a fixed scroll 140 engaged with the orbiting scroll 150 to form a compression chamber V together with the orbiting scroll 150; a bushing 145 disposed between the compression part and the rotation shaft 125 and coupled to an outer circumference of the rotation shaft 125 to rotate together with the rotation shaft 125; and a fixed bearing 172 disposed between the fixed scroll 140 and the bushing 145 and fitted to an inner circumference of the fixed scroll 140.

In addition, the bushing 145 slidably rotates relative to the fixed bearing 172, and the bushing 145 is supported by one surface disposed inside the fixed bearing 172.

The scroll compressor 10 according to the present disclosure may be a shaft-through scroll compressor 10 in which the rotation shaft 125 is disposed to penetrate the orbiting scroll 150 and the fixed scroll 140. As illustrated in FIG. 15, the scroll compressor 10 can be understood as a "shaft-through scroll compressor" in which the rotation shaft 125 is disposed to penetrate the compression part including the orbiting scroll 150 and the fixed scroll 140.

Meanwhile, the scroll compressor 10 according to the present disclosure is a bottom-compression type scroll compressor as illustrated in FIG. 15, and although the description is mainly given of the bottom-compression type scroll compressor, the present disclosure is not necessarily limited thereto.

That is, the scroll compressor 10 according to the present disclosure, if it is the shaft-through scroll compressor, may also be applied to a top-compression type scroll compressor in which the compression unit is located above the electromotive part 120.

In addition, according to the present disclosure, the bushing 145 is arranged between the compression part and the rotation shaft 125 and is coupled to the outer circumference of the rotation shaft 125 to rotate together with the rotation shaft 125, thereby reducing the surface pressure applied between the compression part and the rotation shaft 125.

More specifically, the rotation shaft 125 may be disposed to penetrate the fixed scroll 140, and the bushing 145 may be disposed between the rotation shaft 125 and the fixed scroll 140.

The fixed bearing 172 may be disposed between the fixed scroll 140 and the bushing 145, and may be inserted and coupled to an inner circumference of the fixed scroll 140 in a fitting manner. That is, the outer circumference of the fixed bearing 172 is fitted to the inner circumference of the fixed scroll 140, and the bushing 145 is installed on the inner circumference of the fixed bearing 172.

At this time, the fixed bearing 172 is fixedly fitted to the inner circumference of the fixed scroll 140. On the other hand, the bushing 145 is made to slidably rotate relative to the fixed bearing 172, to rotate together with the rotation shaft 125 and slide relative to the fixed bearing 172.

By virtue of the structure in which the bushing 145 is installed between the fixed bearing 172 and the rotation shaft 125, a structure is formed in which the diameter of the fixed bearing 172 installed in the fixed scroll 140 is increased to reduce the surface pressure.

In the present disclosure, the surface pressure is a value obtained by dividing a load by a projected area (length*inner diameter) of the fixed bearing. When the value is small, a better condition is obtained in view of reliability, namely, the load is small or well distributed. In the present disclosure, the surface pressure is reduced by enlarging the projection area, i.e., the inner diameter.

A detailed structure related to this will be described later.

In addition, a description will be given of a bottom-compression type scroll compressor 10 in which the electromotive part 120 and the compression part are arranged vertically in an axial direction and the compression part is located below the electromotive part 120.

In addition, a description will be given of a bottom-compression and high-pressure type scroll compressor in which a refrigerant suction pipe defining a suction passage is directly connected to a compression part and a refrigerant discharge pipe 116 communicates with an inner space of a casing 110.

However, the scroll compressor 10 according to the present disclosure is not necessarily limited to the bottom-compression type, and may also be applied to the top-compression type in which the compression part is located above the electromotive part 120.

The scroll compressor 10 according to the present disclosure may be an inverter type scroll compressor. The scroll compressor 10 can operate in the range from a low speed to a high speed. The scroll compressor 10 may also be a high-pressure type and a bottom-compression type.

FIG. 15 illustrates the bottom-compression type scroll compressor 10. As illustrated in FIG. 15, the scroll compressor 10 according to an embodiment of the present disclosure can be understood as a bottom-compression type scroll compressor 10 in which the electromotive part 120 constituting a electromotive part in the internal space 1*a* of the casing 110 and generating rotational force is installed in an upper portion of the casing 110, and the compression part compressing refrigerant by receiving the rotational force of the electromotive part 120 is installed below the electromotive part 120.

The casing 110 has an oil storage space S11. As an example, the electromotive part 120 may be disposed in the upper portion of the casing 110, and the main frame 130, the orbiting scroll 150, the fixed scroll 140, and the discharge cover 160 may be sequentially disposed below the electromotive part 120.

The electromotive part 120 may be configured to convert external electrical energy into mechanical energy.

In addition, the main frame 130, the orbiting scroll 150, the fixed scroll 140, and the discharge cover 160 may configure the compression part that compresses refrigerant by receiving the mechanical energy generated in the electromotive part 120.

Referring to FIG. 15, an example is shown in which the electromotive part 120 is coupled to an upper end of the rotation shaft 125 to be explained later, and the compression part is coupled to a lower end of the rotation shaft 125. That is, the scroll compressor 10 may have a bottom-compression type structure.

In summary, the scroll compressor 10 includes the electromotive part 120 and the compression part which are received in the inner space 110*a* of the casing 110.

The casing 110 may include a cylindrical shell 111, an upper shell 112 and a lower shell 113.

The cylindrical shell 111 may be formed in a cylindrical shape with both ends open.

The upper shell 112 may be coupled to an upper end portion of the cylindrical shell 111, and the lower shell 113 may be coupled to a lower end portion of the cylindrical shell 111.

That is, both the upper and lower end portions of the cylindrical shell 111 are coupled to the upper shell 112 and the lower shell 113, respectively, in a covering manner. The cylindrical shell 111, the upper shell 112 and the lower shell 113 that are coupled together define the inner space 110*a* of the casing 110. At this time, the inner space 110*a* is sealed.

The sealed inner space 110*a* of the casing 110 is divided into a lower space S1, an upper space S2, an oil storage space S11, and a discharge space S3.

The lower space S1 and the upper space S2 are defined in an upper side of the main frame 130 and the oil storage space S11 and the discharge space S3 are defined in a lower side of the main frame 130.

The lower space S1 indicates a space defined between the electromotive part 120 and the main frame 130, and the upper space S2 indicates a space above the electromotive part 120. In addition, the oil storage space S11 indicates a space below the discharge cover 160, and the discharge space S3 indicates a space defined between the discharge cover 160 and the fixed scroll 140.

One end of the refrigerant suction pipe 115 is coupled through a side surface of the cylindrical shell 111. Specifically, the one end of the refrigerant suction pipe 115 is coupled through the cylindrical shell 111 in a radial direction of the cylindrical shell 111.

The refrigerant suction pipe 115 may be coupled directly to the suction port (not shown) formed in the side portion of the fixed scroll 140 through the cylindrical shell 111. Accordingly, refrigerant can be introduced into a compression chamber V through the refrigerant suction pipe 115.

The accumulator 50 is coupled to another end, different from the one end, of the refrigerant suction pipe 115.

The accumulator 50 is connected to an outlet side of an evaporator 40 through a refrigerant pipe. Accordingly, while refrigerant flows from the evaporator to the accumulator 50, liquid refrigerant is separated in the accumulator 50, and only a gaseous refrigerant is directly introduced into a compression chamber through the refrigerant suction pipe 115.

A refrigerant discharge pipe 116 is coupled through an upper portion of the upper shell 112 to communicate with the inner space 110*a* of the casing 110. Accordingly, refrigerant discharged from the compression part into the inner space 110*a* of the casing 110 flows to a condenser (not shown) through the refrigerant discharge pipe 116.

The fixed scroll 140 is disposed inside the casing 110. The orbiting scroll 150 is disposed on one side of the fixed scroll 140 to be pivotable, and the fixed scroll 140 forms the compression chamber V together with the orbiting scroll 150.

In addition, the discharge cover 160 is disposed on another side of the fixed scroll 140, opposite to the one side.

The fixed scroll 140 includes a fixed wrap 144. The fixed scroll 140 may further include a sub bearing hole 1431.

The fixed scroll 140 may include a fixed end plate portion 141, a fixed side wall portion 142, a sub bearing portion 143, and a fixed wrap 144. A detailed structure of the fixed scroll 140 will be described later.

The orbiting scroll 150 performs an orbital motion relative to the fixed scroll 140, and is engaged with the fixed wrap 144 to form the compression chamber V.

For example, the orbiting scroll 150 may include an orbiting wrap 152 engaged with the fixed wrap of the fixed scroll 140 to form the compression chamber V, and an orbiting end plate portion 151 connected at one end of the orbiting wrap 152 and having a predetermined width. A detailed structure of the orbiting scroll 150 will be described later.

The rotation shaft 125 may be disposed inside the casing 110 in one direction and installed through the inner circumferences of the fixed scroll 140 and the orbiting scroll 150 to transfer rotational force to enable the orbital motion of the orbiting scroll 150.

The discharge cover 160 is coupled to another side of the fixed scroll 140, which is opposite to the one side thereof defining the compression chamber V. The discharge cover 160 also has a cover bottom surface 1611 forming a bottom of the discharge cover 160. The discharge cover 160 includes a cover side surface 1612 forming the side surface thereof.

A through hole 1611*a* may be formed through a central portion of the cover bottom surface 1611 in the axial direction. A sub bearing portion 143 protruding downward from the fixed end plate portion 141 may be inserted into the through hole 1611*a*, but is not necessarily limited to this structure, and the through hole 1611*a* may be formed in a boss shape and may be inserted directly into the inner circumference of the fixed end plate portion 141 of the fixed scroll 140 rather than the sub bearing portion 143 of the fixed scroll 140.

A discharge hole 163 that can communicate with the inside of the oil feeder 127 may be formed in the cover bottom surface 1611.

The oil feeder 127 is coupled to the cover bottom surface 1611 to face an opposite direction to the fixed scroll 140, so as to communicate with the oil storage space S11.

Referring to FIG. 15, in the high-pressure and bottom-compression type scroll compressor 10 according to an embodiment of the present disclosure, the electromotive part 120 constituting the electromotive part 120 is installed in the upper half portion of the casing 110, and the main frame 130, the fixed scroll 140, the orbiting scroll 150, and the discharge cover 160 are sequentially disposed below the electromotive part 120. Typically, the compression part may include the main frame 130, the fixed scroll 140, the orbiting scroll 150, and the discharge cover 160.

The electromotive part 120 is coupled to an upper end of the rotation shaft 125 to be explained later, and the compression part is coupled to a lower end of the rotation shaft 125. Accordingly, the compressor has the bottom-compression type structure described above, and the compression part is connected to the electromotive part 120 by the rotation shaft 125 to be operated by the rotational force of the electromotive part 120.

Referring to FIG. 15, the casing 110 according to the embodiment may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111.

Accordingly, the inner space 110*a* of the casing 110 may be sealed. The sealed inner space 110*a* of the casing 110 is divided into a lower space S1 and an upper space S2 based on the electromotive part 120.

The lower space S1 is a space defined below the electromotive part 120. The lower space S1 may be further divided into an oil storage space S11 and an outflow space S12 with the compression part therebetween.

The oil storage space S11 is a space defined below the compression part to store oil or mixed oil in which liquid refrigerant is contained. The outflow space S12 is a space defined between an upper surface of the compression part and a lower surface of the electromotive part 120. Refrigerant compressed in the compression part or mixed refrigerant in which oil is contained is discharged into the outflow space S12.

The upper space S2 is a space defined above the electromotive part 120 to form an oil separating space in which oil is separated from refrigerant discharged from the compression part. A refrigerant discharge pipe 116 communicates with the upper space S2.

The electromotive part 120 and the main frame 130 are fixedly inserted into the cylindrical shell 111. An outer circumferential surface of the electromotive part 120 and an outer circumferential surface of the main frame 130 may be respectively provided with an oil return passages Po1 and Po2 each spaced apart from an inner circumferential surface of the cylindrical shell 111 by a predetermined distance. This will be described again later together with an oil return passage.

A refrigerant suction pipe 115 is coupled through a side surface of the cylindrical shell 111. Accordingly, the refrigerant suction pipe 115 is coupled through the cylindrical shell 111 forming the casing 110 in a radial direction.

The refrigerant suction pipe 115 is formed in an L-like shape. One end of the refrigerant suction pipe 115 is inserted through the cylindrical shell 111 to directly communicate with the suction port of the fixed scroll 140, which configures the compression part. Accordingly, refrigerant can be introduced into a compression chamber V through the refrigerant suction pipe 115.

Another end of the refrigerant suction tube 115 may be connected to an accumulator 50 which defines a suction passage outside the cylindrical shell 111. The accumulator 50 may be connected to an outlet side of the evaporator 40 through the refrigerant pipe. Accordingly, while refrigerant flows from the evaporator to the accumulator 50, liquid refrigerant may be separated in the accumulator 50, and only gaseous refrigerant may be directly introduced into the compression chamber V through the refrigerant suction tube 115.

A terminal bracket (not shown) may be coupled to an upper portion of the cylindrical shell 111 or the upper shell 112, and a terminal (not shown) for transmitting external power to the electromotive part 120 may be coupled through the terminal bracket.

An inner end of the refrigerant discharge pipe 116 is coupled through an upper portion of the upper shell 112 to communicate with the inner space 110*a* of the casing 110, specifically, the upper space S2 defined above the electromotive part 120.

The refrigerant discharge pipe 116 corresponds to a passage through which compressed refrigerant discharged from the compression part to the inner space 110*a* of the casing 110 is exhausted toward a condenser (not illustrated). The refrigerant discharge pipe 116 may be disposed coaxially with the rotation shaft 125 to be described later. Accordingly, a venturi tube 191 disposed in parallel with the refrigerant discharge pipe 116 may be eccentrically disposed with respect to an axial center of the rotation shaft 125.

The refrigerant discharge pipe 116 may be provided therein with the accumulator 50 for separating oil from refrigerant discharged from the compressor 10 to the condenser, or a check valve (not shown) for suppressing refrigerant discharged from the compressor 10 from flowing back into the compressor 10.

Hereinafter, the electromotive part 120 will be described with reference to FIG. 15. The electromotive part 120 according to an embodiment of the present disclosure includes a stator 121 and a rotor 122. The stator 121 is fitted onto the inner circumferential surface of the cylindrical shell 111, and the rotor 122 is rotatably disposed in the stator 121.

The stator 121 includes a stator core 1211 and a stator coil 1212.

The stator core 1211 is formed in an annular shape or a hollow cylindrical shape and is shrink-fitted onto the inner circumferential surface of the cylindrical shell 111.

A rotor accommodating portion 1211*a* is formed in a circular shape through a central portion of the stator core 1211 such that the rotor 122 can be rotatably inserted therein. A plurality of stator-side return grooves 1211*b* may be recessed or cut out in a D-cut shape at an outer circumferential surface of the stator core 1211 along the axial direction and disposed at preset distances along a circumferential direction.

A plurality of teeth (not illustrated) and slots (not illustrated) are alternately formed on an inner circumferential surface of the rotor accommodating portion 1211*a* in the circumferential direction, and the stator coil 1212 is wound on each tooth by passing through the slots at both sides of the tooth.

More precisely, the slots may be spaces between circumferentially neighboring stator coils. In addition, the slot defines an inner passage 120*a*, an air gap passage is defined between the inner circumferential surface of the stator core 1211 and an outer circumferential surface of a rotor core 1221 to be described later, and an oil return groove 1211*b* defines an external passage. The inner passages 120*a* and the air gap passage define a passage through which refrigerant discharged from the compression part moves to the upper space S2, and the external passage defines a first oil return passage Po1 through which oil separated in the upper space S2 is returned to the oil storage space S11.

The stator coil 1212 is wound around the stator core 1211 and electrically connected to an external power source through a terminal (not illustrated) that is coupled through the casing 110. An insulator 1213, which is an insulating member, is inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 includes a rotor core 1221 and permanent magnets 1222.

The rotor core 1221 is formed in a cylindrical shape to be accommodated in a rotor accommodating portion 1211*a* defined in the central portion of the stator core 1211.

Specifically, the rotor core 1221 is rotatably inserted into the rotor accommodating portion 1211*a* of the stator core 1211 with a predetermined gap 120*a* therebetween. The permanent magnets 1222 are embedded in the rotor core 1222 at preset distances along the circumferential direction.

A balance weight 123 may be coupled to a lower end of the rotor core 1221. Alternatively, the balance weight 123 may be coupled to a main shaft portion 1251 of the rotation shaft 125 to be described later. This embodiment of the present disclosure will be described based on an example in which the balance weight 123 is coupled to a lower end of the rotor core 1221.

In addition, the balance weight 123 is coupled to the lower end of the rotor core 1221 and rotates in response to rotation of the rotor 122.

A gas vent hole 190 may be formed through the outer periphery of the balance weight 123 to relieve a pressure difference at the lower portion caused by the discharge hole 163 and to allow the refrigerant to flow upward.

The rotation shaft 125 is coupled to the center of the rotor core 1221. An upper end portion of the rotation shaft 125 is press-fitted to the rotor 122, and a lower end portion of the rotation shaft 125 is rotatably inserted into the main frame 130 to be supported in the radial direction.

An air gap or a winding gap through which discharge refrigerant can flow may be defined in the rotor 122.

The main frame 130 is provided with a main bearing 171 configured as a bush bearing to support the first bearing portion 1252 of the rotation shaft 125. Accordingly, a portion, which is inserted into the main frame 130, of the lower end portion of the rotation shaft 125 can smoothly rotate inside the main frame 130.

The rotation shaft 125 transfers the rotational force of the electromotive part 120 to the orbiting scroll 150 constituting the compression part. Accordingly, the orbiting scroll 150 eccentrically coupled to the rotation shaft 125 may perform an orbital motion with respect to the fixed scroll 140.

Referring to FIG. 15, the rotation shaft 125 according to the implementation includes a main shaft portion 1251, a first bearing portion 1252, a fixed bearing portion 1253, and an eccentric portion 1254.

The main shaft portion 1251 is an upper portion of the rotation shaft 125 and formed in a cylindrical shape. The main shaft portion 1251 may be partially press-fitted to the stator core 1221.

The first bearing portion 1252 is a portion extending from a lower end of the main shaft portion 1251. The first bearing portion 1252 may be inserted into a main bearing hole 133*a* of the main frame 130 so as to be supported in the radial direction.

The fixed bearing portion 1253 indicates a lower portion of the rotation shaft 125. The fixed bearing portion 1253 may be inserted into a sub bearing hole 143*a* of the fixed scroll 140 so as to be supported in the radial direction. A central axis of the fixed bearing portion 1253 and a central axis of the first bearing portion 1252 may be aligned on the same line. That is, the first bearing portion 1252 and the fixed bearing portion 1253 may have the same central axis.

As described above, the bushing 145 may be coupled to the outer circumference of the rotation shaft 125, and disposed between the compression part and the rotation shaft 125.

Accordingly, the bushing 145 rotates together with the rotation shaft 125, and the surface pressure applied between the compression part and the rotation shaft 125 is reduced.

The fixed bearing portion 1253 of the rotation shaft 125 may be arranged to penetrate the fixed scroll 140, and the bushing 145 may be coupled to the outer circumference of the fixed bearing portion 1253.

Meanwhile, the fixed bearing 172 coupled to the inner circumference of the fixed scroll 140 is press-fitted to the outer circumference of the fixed bearing portion 1253 to which the bushing 145 is coupled. Accordingly, the fixed bearing portion 1253 of the rotation shaft 125, the bushing 145, the fixed bearing 172, and the fixed scroll 140 are disposed sequentially from inside to outside (see FIG. 16).

The bushing 145 may slidably rotate relative to the fixed bearing 172. That is, the bushing 145 forms a structure that slides relative to the fixed bearing 172.

In addition, the fixed bearing portion 1253 may include a large-diameter portion 1253*a* having a larger diameter than the cross-section of the adjacent rotation shaft 125, and a small-diameter portion 1253*d* connected to the large-diameter portion 1253*a* and having a smaller diameter than the cross-section of the adjacent rotation shaft 125.

It can be understood that the large-diameter portion 1253*a* and the small-diameter portion 1253*d* have different diameters at portions in contact with the bushing 145.

The fixed bearing portion 1253 of the rotation shaft 125 may include a support surface 1253*b* formed on at least a portion of the outer circumference thereof to support the bushing 145 in the circumferential direction.

Figure 16:
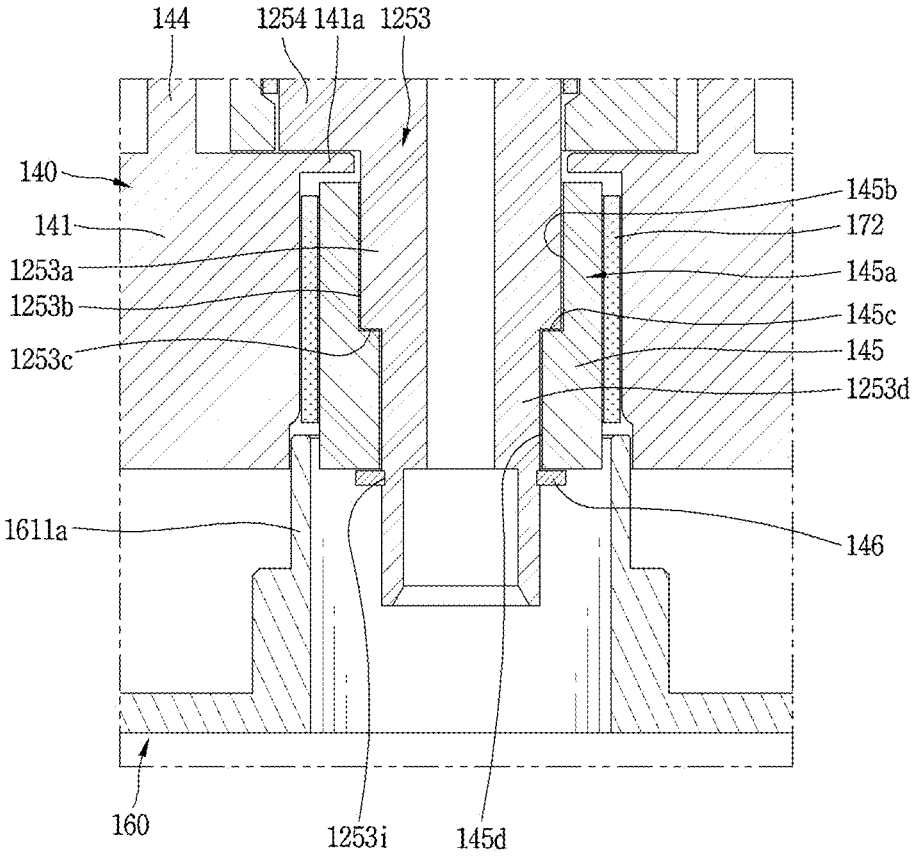
FIG. 16 is a cross-sectional view illustrating an example in which a bushing is inserted into a rotation shaft.

Referring to FIG. 16, the support surface 1253*b* may be disposed on the large-diameter portion 1253*a*.

Additionally, the support surface 1253*b* may be formed by cutting the outer circumferential surface of the large-diameter portion 1253*a* in a tangential direction.

The support surface 1253*b* may be provided by two in parallel to each other on the outer circumference of the fixed bearing portion 1253 of the rotation shaft 125.

The support surface 1253*b* can be understood as a "D-cut structure" formed by cutting a D-shaped cross-section from the fixed bearing portion 1253.

Figure 22:
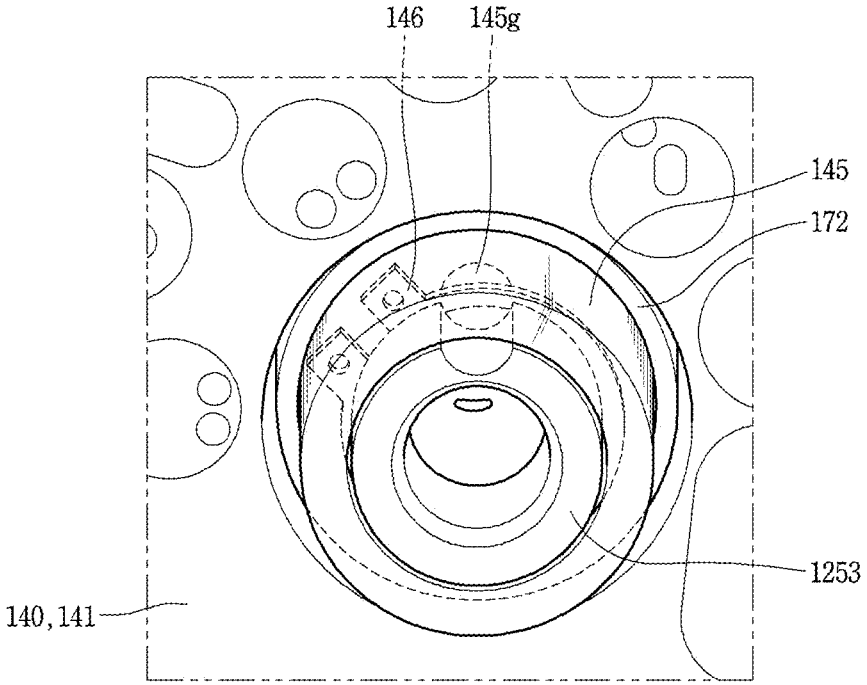
FIG. 22 is a perspective view illustrating an example in which a bushing is supported circumferentially with respect to a rotation shaft by a pin structure.

In addition, the fixed bearing portion 1253 may include a support end portion 1253*c* that axially supports the bushing 145. As illustrated in FIG. 22, the support end portion 1253*c* may be disposed on the lower surface of the large-diameter portion 1253*a*.

For example, the large-diameter portion 1253*a* may have the support end portion 1253*c*. The support end portion 1253*c* is disposed on the lower surface of the large-diameter portion 1253*a*. In addition, the support end portion 1253*c* may axially support the bushing between the large-diameter portion and the small-diameter portion.

Additionally, the bushing 145 may be provided with a first hole 145*a* and a second hole 145*d*.

The first hole 145*a* is formed such that the large-diameter portion 1253*a* of the fixed bearing portion 1253 is inserted therein.

For example, the first hole 145*a* may have a holding surface 145*b* on which the support surface 1253*b* of the fixed bearing portion 1253 is supported in the radial direction.

The holding surface 145*b* is formed parallel to the support surface 1253*b* and is configured to be supported by the support surface 1253*b*.

Additionally, the support surface 145*b* may be provided by two to support the support surfaces 1253*b* from both sides.

In addition, the first hole 145*a* may have a mounting surface 145*c* on which the support end portion 1253*c* of the fixed bearing portion 1253 is axially supported.

Figure 17:
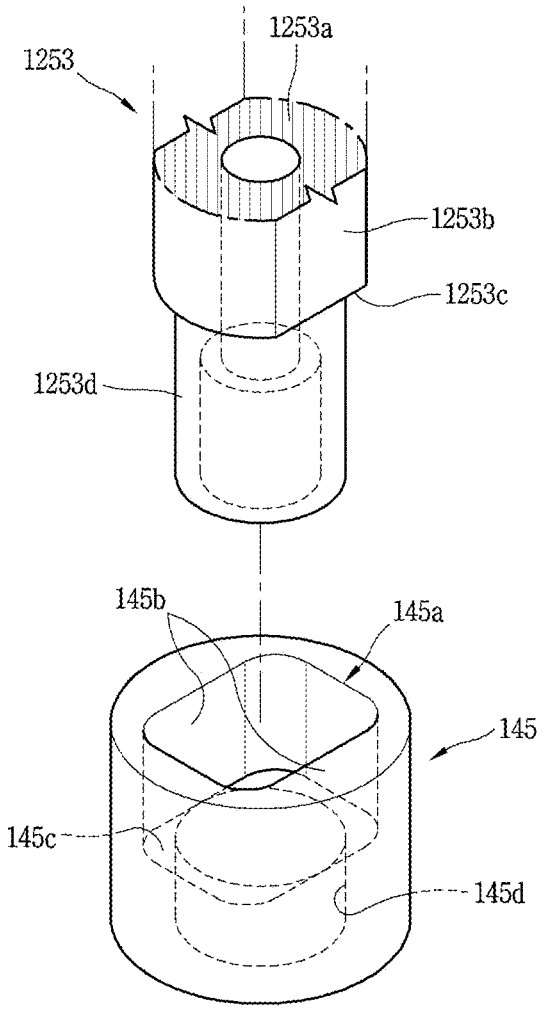
FIG. 17 is a perspective view illustrating a structure and assembly direction of a rotation shaft and a bushing.
Figure 18:
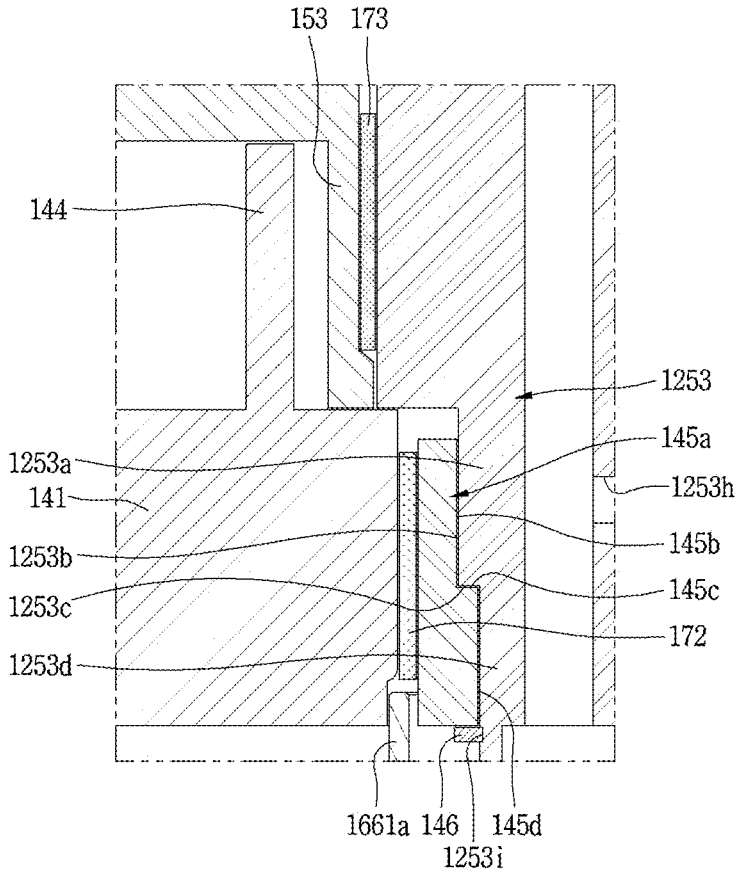
FIG. 18 is a cross-sectional view illustrating the related art structure in which a compression chamber and a fixed bearing of a fixed scroll do not communicate with each other.

Referring to FIG. 17, the first hole 145*a* has a mounting surface 145*c* on which the support end portion 1253*c* of the fixed bearing portion 1253 is axially supported.

In addition, it can be understood that the mounting surface 145*c* is provided on top of the second hole.

And, the small-diameter portion 1253*d* of the fixed bearing portion 1253 may be inserted into the second hole 145*d*.

The bushing 145 is coupled such that the holding surface 145*b* is in contact with the support surface 1253*b* disposed on the fixed bearing portion 1253 of the rotation shaft 125, to thus be supported radially with respect to the rotation shaft 125.

In addition, the bushing 145 is coupled to the fixed bearing portion 1253 of the rotation shaft 125 such that the mounting surface 145*c* is mounted on the support end portion 1253*c* disposed on the fixed bearing portion 1253 of the rotation shaft 125, thereby being supported axially with respect to the rotation shaft 125.

In this way, as the bushing 145 is coupled to the rotation shaft 145 to be supported in the axial and radial directions, the bushing 145 can rotate together with the rotation shaft 125 and slidably rotate relative to the fixed bearing 172.

Additionally, the bushing 145 may have predetermined outer diameter or width. As described above, the fixed bearing portion 1253 is provided with the large-diameter portion 1253*a*, and the bushing 145 has the predetermined sufficient outer diameter or width, so that the fixed bearing 172 installed on the inner circumference of the fixed scroll 140 can have a relatively wide diameter by the outer diameter of the bushing 145, thereby achieving the effects of reducing the surface pressure and increasing the Sommerfeld number.

Meanwhile, an anti-separation member 146 may be installed on the fixed bearing portion 1253 of the rotation shaft 125 to support the bushing 145 from the bottom, so that the bushing 145 can be supported more firmly in the axial direction. The anti-separation member 146, as illustrated in FIG. 22, may be configured as a snap ring, for example. However, the anti-separation member 146 may not be necessarily limited to the configuration of the snap ring, and may be configured as a spring or a thrust plate to firmly support the bushing 145 in the axial direction.

For example, the fixed bearing portion 1253 may include an anti-separation receiving groove 1253*i* formed concavely in the outer circumference thereof in the circumferential direction to receive the anti-separation member 146 therein.

The anti-separation receiving groove 1253*i* must be located in the outer circumference of the fixed bearing portion 1253 of the rotation shaft 125 at a position where the anti-separation member 146 can support the bottom of the bushing 145.

By virtue of the anti-separation member 146, the bushing 145 can be suppressed from being separated from the rotation shaft 146 in the direction of gravity and can be supported in the axial direction.

As described above, by installing the bushing 145 between the rotation shaft 125 and the fixed bearing 172, the diameter of the fixed bearing 172 can be increased, a sufficient compression space can be secured because the bearing of the orbiting scroll 150 is not expanded.

In the present disclosure, by applying the structure of the bushing 145, when the inner diameter of the fixed bearing 172 is excessively enlarged or the eccentricity of the fixed bearing 172 is increased, the compression chamber V may communicate with the fixed bearing 172. This arrangement, in which the compression chamber V and the fixed bearing 172 are in communication, may result from the change in orbiting angle of the orbiting scroll 150.

When the compression chamber V and the fixed bearing 172 are in compression, high-pressure compressed refrigerant gas inside the compression chamber V may flow into the oil supply passage, causing failure of oil supply, or conversely, oil may flow into the compression chamber V, causing a deterioration of compression efficiency.

To suppress the communication between the compression chamber V and the fixed bearing 172, a sealing surface portion 141*a* may be disposed on the upper end surface of the fixed end plate portion 141, facing the orbiting scroll 150, of the fixed scroll 140 to protrude more than the inner diameter of the fixed bearing 172.

The sealing surface portion 141*a* may protrude inwardly from the upper surface of the fixed scroll 140. For example, the sealing surface portion 141*a* may be formed to protrude from the fixed end plate portion 141 up to a more inward position than the position where the inner circumference of the fixed bearing 172 is arranged.

Additionally, the lower portion of the sealing surface portion 141*a* may be spaced apart from the upper surface of the bushing 145 by a predetermined distance.

Due to this, the sealing surface portion 141*a* seals the compression chamber V at a position spaced apart from the upper surface of the bushing 145 by the predetermined distance.

Figure 19:
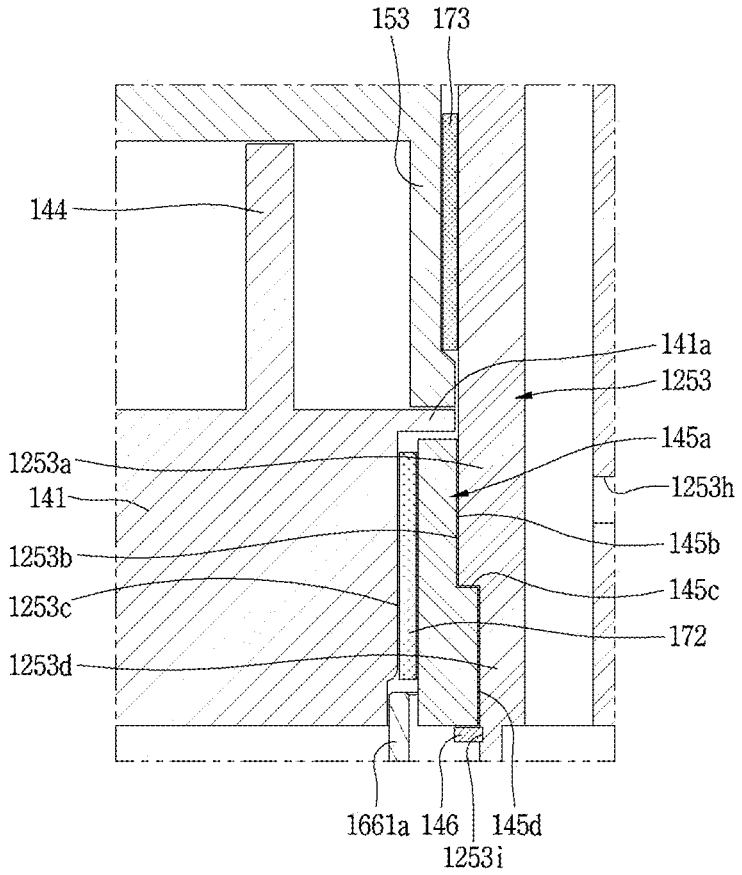
FIG. 19 is a cross-sectional view illustrating a structure in which a sealing protrusion surface is formed on the top of a fixed scroll so as to face an orbiting scroll at the top of a fixed bearing.

In addition, it is preferable that the sealing surface portion 141*a* seals the compression chamber V by extending a right end portion in FIG. 19 up to the orbiting wrap 152 inside the orbiting scroll 150.

Accordingly, the sealing surface portion 141*a* can suppress the communication between the compression chamber V and the fixed bearing 172.

The scroll compressor 10 according to the present disclosure has been described above with respect to the example in which the support surface 1253*b* is formed on the large-diameter portion 1253*a* of the fixed bearing portion 1253 and the first hole 145*a* is formed in the bushing 145 in relation to the manner of coupling the bushing 145 to the rotation shaft 125, but the bushing 145 may also be coupled to the rotation shaft 125 in other ways, i.e., by a key structure and a pin structure.

Figure 20:
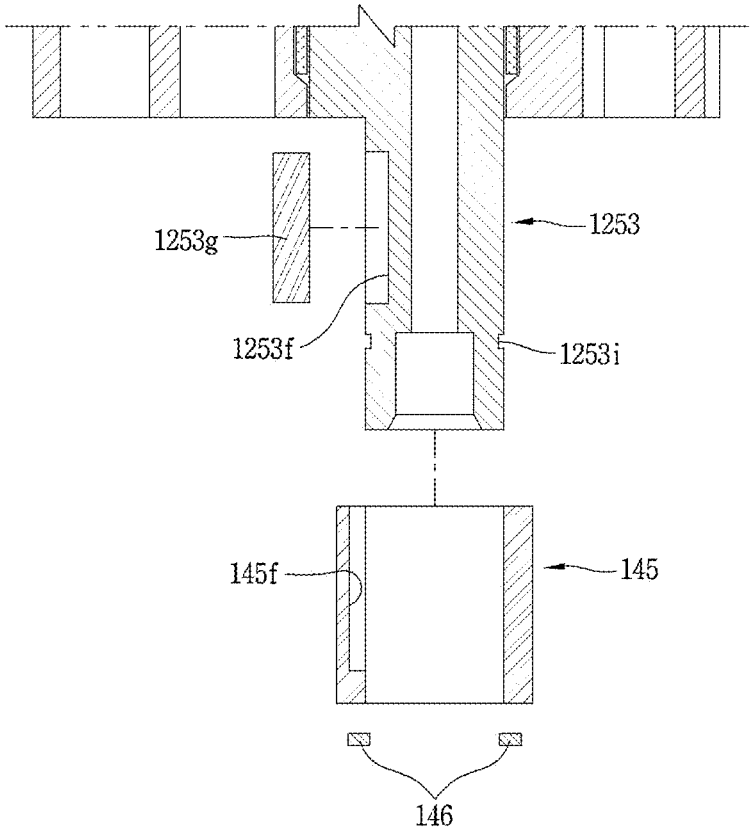
FIG. 20 is an exploded cross-sectional view illustrating an example in which a bushing is supported circumferentially with respect to a rotation shaft by a key structure.
Figure 21:
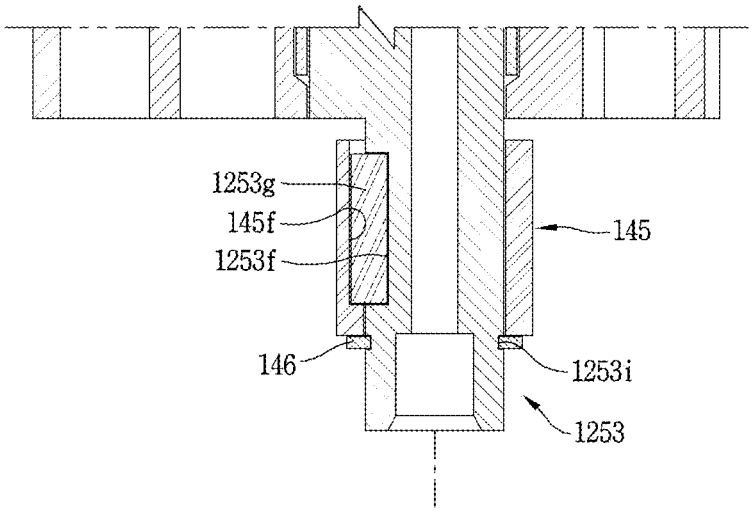
FIG. 21 is a cross-sectional view illustrating an example in which a bushing is supported circumferentially with respect to a rotation shaft by a key structure.
Figure 23:
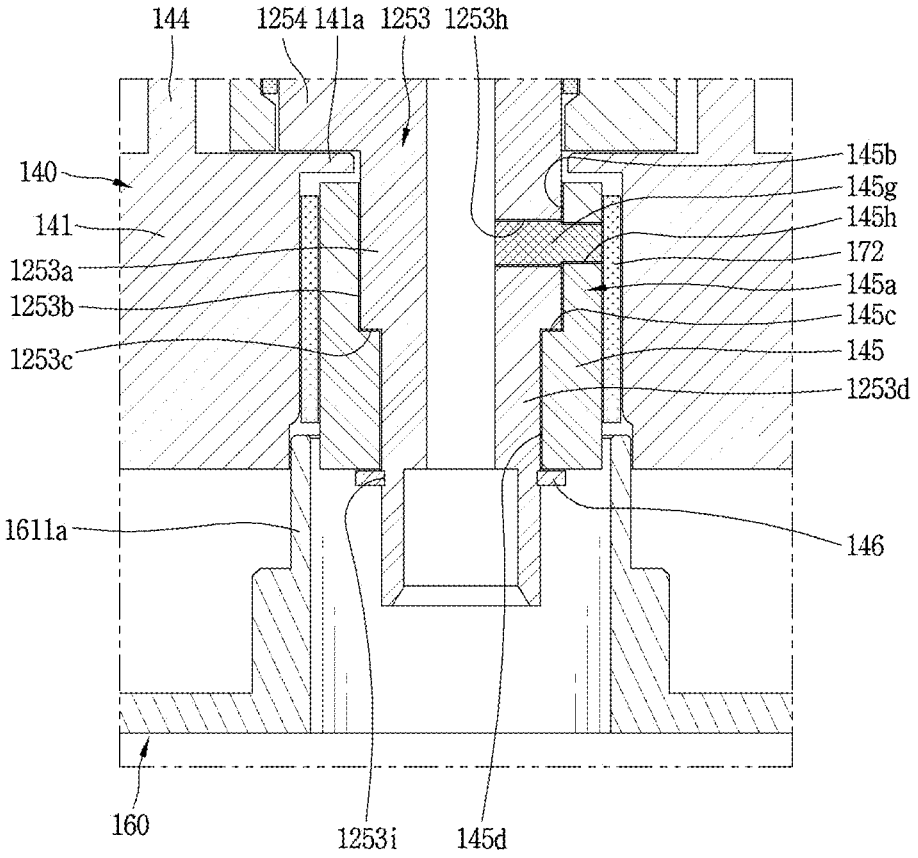
FIG. 23 is a perspective view illustrating an example in which a bushing is coupled to a rotation shaft by a pin structure and a D-cut structure and supported circumferentially.
Figure 25:
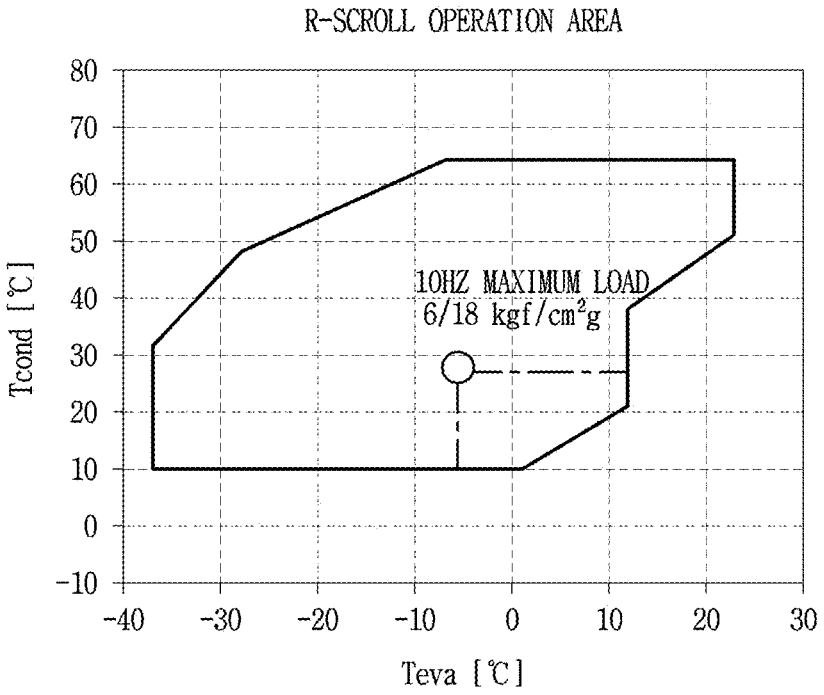
FIG. 25 is a graph showing the results of maximum load, etc. in a scroll operation area.

FIG. 20 is an exploded cross-sectional view illustrating an example in which the bushing 145 is supported circumferentially with respect to the rotation shaft 125 by a key structure, and FIG. 21 is a cross-sectional view illustrating an example in which the bushing 145 is supported circumferentially with respect to the rotation shaft 125 by the key structure. In addition, FIG. 22 is a perspective view illustrating an example in which the bushing 145 is supported circumferentially with respect to the rotation shaft 125 by a pin structure. FIG. 23 is a perspective view illustrating an example in which the bushing 145 is supported circumferentially with respect to the rotation shaft 125 by a pin structure and a D-cut structure.

Hereinafter, a method of coupling the bushing 145 to the rotation shaft 125 by a key structure will be described with reference to FIGS. 20 and 21.

A key receiving groove 1253*f* may be formed in the outer circumference of the rotation shaft 125.

For example, the key receiving groove 1253*f* may be formed axially in the outer circumference of the fixed bearing portion 1253 of the rotation shaft 125. Additionally, the key receiving groove 1253*f* may have a predetermined width so that a key 1253*g* having a predetermined width is inserted in a lateral direction as illustrated in FIGS. 20 and 21.

When the key receiving groove 1253*f* is provided, the fixed bearing portion 1253 of the rotation shaft 125 may not have the large-diameter portion 1253*a* described above.

Referring to FIGS. 20 and 21, an example is illustrated in which the key receiving groove 1253*f* is formed in the upper and lower (vertical) direction in the outer circumference of the fixed bearing portion 1253 of the rotation shaft 125.

The key 1253*g* may be inserted to protrude in the radial direction of the rotation shaft 125 while being coupled to the key receiving groove 1253*f*. That is, in FIGS. 20 and 21, the radial width of the key 1253*g* must be larger than the radial width (depth) of the key receiving groove 1253*f*.

Additionally, the key 1253*g* may have a circular or rectangular cross-section.

In addition, a support groove 145*f* may be formed in the inner circumference of the bushing 145, and the key 1253*g* which is installed in the key receiving groove 1253*f* of the fixed bearing portion 1253 and protrudes in the radial direction may be fitted to the inner circumference of the bushing 145.

The support groove 145*f* must be formed in a shape corresponding to the key 1253*g*. That is, the support groove 145*f* may have a cross-section in an arcuate shape or a shape like "⊏".

The key 1253*g* and the support groove 145*f* may be formed to have a longer axial length than a radial length.

As the key 1253*g* is installed in the key receiving groove 1253*f* and the key 1253*g* protruding from the key receiving groove 1253*f* is forcefully fitted into the support groove 145*f* of the bushing 145, the bushing 145 can be supported on the rotation shaft 125.

Meanwhile, the anti-separation member 146 may be installed on the fixed bearing portion 1253 of the rotation shaft 125 to support the bushing 145 from the bottom, so that the bushing 145 can be supported more firmly in the axial direction, even when the key structure is applied. The anti-separation member 146, as illustrated in FIG. 22, may be configured as a snap ring, for example. However, the anti-separation member 146 may not be necessarily limited to the configuration of the snap ring, and may be configured as a spring or a thrust plate to firmly support the bushing 145 in the axial direction.

For example, the fixed bearing portion 1253 may include an anti-separation receiving groove 1253*i* formed concavely in the outer circumference thereof in the circumferential direction to receive the anti-separation member 146 therein.

The anti-separation receiving groove 1253*i* must be located in the fixed bearing portion 1253 of the rotation shaft 125 at a position where the anti-separation member 146 can support the bottom of the bushing 145.

Hereinafter, a method of coupling the bushing 145 to the rotation shaft 125 by a pin structure will be described with reference to FIGS. 22 and 23.

A pin 145*g* may be fitted to the outer circumference of the rotation shaft 125 in the radial direction.

In addition, the bushing 145 may be provided with a pin coupling hole 145*h* into which the pin 145*g* is inserted, and the pin 145*g* may be inserted into the pin coupling hole 145*h*.

That is, one side of the pin 145*g* is fitted radially to the outer circumference of the rotation shaft 125, and the pin coupling hole 145*h* of the bushing 145 is fitted to another side of the pin 145*g*, such that the bushing 145 is coupled to the outer circumference of the rotation shaft 125.

As described above, the bushing 145 may be coupled to the fixed bearing portion 1253 of the rotation shaft 125. To this end, the pin receiving hole 1253*h* into which one side of the pin 145*g* can be inserted may be formed in the outer circumference of the fixed bearing portion 1253 of the rotation shaft 125.

Accordingly, by the pin structure in which the bushing 145 is coupled to the rotation shaft 125 by the pin 145*g*, the bushing 145 can be supported radially on the rotation shaft 125 to be suppressed from being separated in the direction of gravity.

Meanwhile, the anti-separation member 146 may be installed on the fixed bearing portion 1253 of the rotation shaft 125 to support the bushing 145 from the bottom, so that the bushing 145 can be supported more firmly in the axial direction, even when the key structure is applied. The anti-separation member 146, as illustrated in FIG. 22, may be configured as a snap ring, for example. However, the anti-separation member 146 may not be necessarily limited to the configuration of the snap ring, and may be configured as a spring or a thrust plate to firmly support the bushing 145 in the axial direction.

For example, the fixed bearing portion 1253 may include an anti-separation receiving groove 1253*i* formed concavely in the outer circumference thereof in the circumferential direction to receive the anti-separation member 146 therein.

The anti-separation receiving groove 1253*i* must be located in the fixed bearing portion 1253 of the rotation shaft 125 at a position where the anti-separation member 146 can support the bottom of the bushing 145.

Meanwhile, the eccentric portion 1254 is formed between a lower end of the first bearing portion 1252 and an upper end of the fixed bearing portion 1253. The eccentric portion 1254 may be inserted into a rotation shaft coupling portion 153 of the orbiting scroll 150 to be described later.

The eccentric portion 1254 may be eccentric with respect to the first bearing portion 1252 and the fixed bearing portion 1253 in the radial direction. That is, a central axis of the eccentric portion 1254 may be eccentric with respect to the central axis of the first bearing portion 1252 and the central axis of the fixed bearing portion 1253. Accordingly, when the rotation shaft 125 rotates, the orbiting scroll 150 can perform an orbiting motion with respect to the fixed scroll 140.

On the other hand, an oil supply passage 126 for supplying oil to the first bearing portion 1252, the fixed bearing portion 1253, and the eccentric portion 1254 may be formed in a hollow shape in the rotation shaft 125. The oil supply passage 126 may include an inner oil passage 1261 defined in the rotational shaft 125 along the axial direction.

As the compression part is located below the electromotive part 120, the inner oil passage 1261 may be formed in a grooving manner from the lower end of the rotation shaft 125 approximately to a lower end or a middle height of the stator 121 or up to a position higher than an upper end of the first bearing portion 1252. Although not illustrated, the inner oil passage 1261 may alternatively be formed through the rotation shaft 125 in the axial direction.

An oil pickup 127 for pumping up oil filled in the oil storage space S11 may be coupled to the lower end of the rotation shaft 125, namely, a lower end of the fixed bearing portion 1253. The oil pickup 127 may include an oil supply pipe 1271 inserted into the inner oil passage 1261 of the rotation shaft 125, and a blocking member 1272 accommodating the oil supply pipe 1271 to block an introduction of foreign materials. The oil feeding pipe 1271 may extend downward through the discharge cover 160 to be immersed in the oil filled in the oil storage space S11.

The rotation shaft 125 may be provided with a plurality of oil feeding holes that communicate with the inner oil passage 1261 to guide oil moving upward along the inner oil passage 1261 to flow toward the first bearing portion 1252, the fixed bearing portion 1253, and the eccentric portion 1254.

Referring to FIG. 15, an example is shown in which the compression part according to an embodiment of the present disclosure includes the main frame 130, the fixed scroll 140, the orbiting scroll 150, and the discharge cover 160.

The main frame 130 is fixedly disposed on an opposite side of the fixed scroll 140 with the orbiting scroll 150 interposed therebetween. In addition, the main frame 130 may accommodate the orbiting scroll 150 to perform the orbital motion.

Referring to FIG. 15, the main frame 130 may include a frame end plate portion 131, a frame side wall portion 132, and a main bearing accommodating portion 133.

The frame end plate portion 131 is formed in an annular shape and disposed below the electromotive part 120. The frame side wall portion 132 may extend in a cylindrical shape from a rim of a lower surface of the main frame 130. For example, the frame side wall portion 132 extends in a cylindrical shape from a rim of a lower surface of the frame end plate portion 131. An outer circumferential surface of the frame side wall portion 132 is fixed to an inner circumferential surface of the cylindrical shell 111 in a shrink-fitting manner or welding manner. Accordingly, the oil storage space S11 and the outflow space S12 constituting the lower space S1 of the casing 110 can be separated from each other by the frame end plate portion 131 and the frame side wall portion 132.

A second outflow hole 1321*a* defining a portion of an outflow passage is formed through the frame side wall portion 132 in the axial direction. The second outflow hole 132*a* may be formed to correspond to a first outflow hole 142*c* of the fixed scroll 140 to be described later, to define a refrigerant outflow passage (no reference numeral given) together with the first outflow hole 142*c*.

As illustrated in FIG. 15, the second outflow hole 132*a* may be elongated in the circumferential direction, or may be provided in plurality disposed at preset distances along the circumferential direction. Accordingly, the second outflow hole 132*a* can secure a volume of a compression chamber V relative to the same diameter of the main frame 130 by maintaining a minimum radial width with securing a discharge area. This may equally be applied to the first outflow hole 142*c* that is formed in the fixed scroll 140 to define a portion of the outflow passage.

An outflow guide groove 132*b* to accommodate the plurality of second outflow holes 132*a* may be formed in an upper end of the second outflow hole 132*a*, namely, an upper surface of the frame end plate portion 131. At least one outflow guide groove 132*b* may be formed according to the position of the second outflow hole 132*a*. For example, when the second outflow holes 132*a* form three groups, the number of discharge guide grooves 132*b* may be three to accommodate the three groups of second outflow holes 132*a*, respectively. The three outflow guide grooves 132*a* may be located on the same line in the circumferential direction.

The outflow guide groove 132*b* may be formed wider than the second outflow hole 132*a*. For example, the second outflow hole 132*a* may be formed on the same line in the circumferential direction together with a first oil return groove 132*c* to be described later. Therefore, when a flow path guide 190 to be described later is provided, the second outflow hole 132*a* having a small cross-sectional area may be difficult to be located at an inner side of the flow path guide 190. With this reason, the outflow guide groove 132*b* may be formed at an end portion of the second outflow hole 132*a* while an inner circumferential side of the outflow guide groove 132*b* extends radially up to the inner side of the flow path guide 190.

Accordingly, the second outflow hole 132*a* can be located adjacent to the outer circumferential surface of the frame 130 by reducing an inner diameter of the second outflow hole 132*a*, and simultaneously can be suppressed from being located at an outer side of the flow path guide 190, namely, adjacent to the outer circumferential surface of the stator 121 due to the flow path guide 190.

A first oil return groove 132*c* that defines a portion of a second oil return passage Po2 may be formed axially through an outer circumferential surface of the frame end plate portion 131 and an outer circumferential surface of the frame side wall portion 132 that define the outer circumferential surface of the main frame 130. The first oil return groove 132*c* may be provided by only one or may be provided in plurality disposed in the outer circumferential surface of the main frame 130 at preset distances in the circumferential direction. Accordingly, the outflow space S12 of the casing 110 can communicate with the oil storage space S11 of the casing 110 through the first oil return groove 132*c*.

The first oil return groove 132*c* may be formed to correspond to a second oil return groove (not shown) of the fixed scroll 140, which will be described later, and define the second oil return passage together with the second oil return groove of the fixed scroll 140.

The main bearing accommodating portion 133 protrudes upward from an upper surface of a central portion of the frame end plate 131 toward the electromotive part 120. The main bearing accommodating portion 133 is provided with a main bearing hole 133*a* formed therethrough in a cylindrical shape along the axial direction. The first bearing portion 1252 of the rotation shaft 125 is inserted into the main bearing hole 133*a* to be supported in the radial direction.

Hereinafter, the fixed scroll 140 will be described with reference to FIG. 15. The fixed scroll 140 according to the embodiment may include the fixed end plate portion 141, the fixed side wall portion 142, the sub bearing portion 143, and the fixed wrap 144.

The fixed end plate portion 141 may be formed in a disk shape having a plurality of concave portions on an outer circumferential surface thereof, and a sub bearing hole 1431 defining the sub bearing portion 143 to be described later may be formed through a center of the fixed end plate portion 141 in the vertical direction. Discharge ports 1411 and 1412 may be formed around the sub bearing hole 1431. The discharge ports 1411 and 1412 may communicate with a discharge pressure chamber Vd so that compressed refrigerant is moved into the outflow space S12 of the discharge cover 160 to be explained later.

Although not illustrated, only one discharge port may be provided to communicate with both of a first compression chamber V1 and a second compression chamber V2 to be described later. In the implementation, however, a first discharge port (no reference numeral given) may communicate with the first compression chamber V1 and a second discharge port (no reference numeral given) may communicate with the second compression chamber V2. Accordingly, refrigerants compressed in the first compression chamber V1 and refrigerant compressed in the second compression chamber V2 can be independently discharged through the different discharge ports.

The fixed side wall portion 142 may extend in an annular shape from an edge of an upper surface of the fixed end plate portion 141 in the vertical direction. The fixed side wall portion 142 may be coupled to face the frame side wall portion 132 of the main frame 130 in the vertical direction.

The first outflow hole 142*c* may be formed through the fixed side wall portion 142 in the axial direction. The first outflow hole 142*c* may be elongated in the circumferential direction or may be provided in plurality disposed at preset distances along the circumferential direction. Accordingly, the first outflow hole 142*c* can secure a volume of a compression chamber V relative to the same diameter of the fixed scroll 140 by maintaining a minimum radial width with securing a discharge area.

The first outflow hole 142*c* communicates with the second outflow hole 132*a* in the state in which the fixed scroll 140 is coupled to the cylindrical shell 111. Accordingly, the first outflow hole 142*c* can define a refrigerant outflow passage together with the second outflow hole 132*a*.

A second oil return groove may be formed in an outer circumferential surface of the fixed side wall portion 142. The second oil return groove communicates with the first oil return groove 132*c* provided in the main frame 130 to guide oil returned along the first oil return groove 132*c* toward the oil storage space S11. Accordingly, the first oil return groove 132*c* and the second oil return groove define the second oil return passage Po2 together with an oil return groove 1612*a* of the discharge cover 160 to be described later.

The fixed side wall portion 142 is provided with a suction port formed through the fixed side wall portion 142 in the radial direction. An end portion of the refrigerant suction pipe 115 inserted through the cylindrical shell 111 is inserted into the suction port. Accordingly, refrigerant can be introduced into the compression chamber V through the refrigerant suction pipe 115.

The sub bearing portion 143 extends in the axial direction from a central portion of the fixed end plate portion 141 toward the discharge cover 160. A sub bearing hole 1431 having a cylindrical shape may be formed through a center of the sub bearing portion 143 in the axial direction, and the fixed bearing portion 1253 of the rotation shaft 125 may be inserted into the sub bearing hole 1431 to be supported in the radial direction. Therefore, the lower end (or the fixed bearing portion) of the rotation shaft 125 can be radially supported by being inserted into the sub bearing portion 143 of the fixed scroll 140, and the eccentric portion 1254 of the rotation shaft 125 can be supported in the axial direction by an upper surface of the fixed end plate portion 141 defining a periphery of the sub bearing portion 143.

The fixed wrap 144 may extend from the upper surface of the fixed end plate portion 141 toward the orbiting scroll 150 in the axial direction. The fixed wrap 144 is engaged with an orbiting wrap 152 to be described later to define the compression chamber V. The fixed wrap 144 will be described later together with the orbiting wrap 152.

Hereinafter, the orbiting scroll 150 will be described with reference to FIG. 15. Specifically, the orbiting scroll 150 according to this embodiment may include an orbiting end plate portion 151, an orbiting wrap 152, and a rotation shaft coupling portion 153.

The orbiting end plate portion 151 is formed in a disk shape and accommodated in the main frame 130. An upper surface of the orbiting end plate portion 151 may be supported in the axial direction by the main frame 130 with interposing a back pressure sealing member (no reference numeral given) therebetween.

The orbiting wrap 152 may extend from a lower surface of the orbiting end plate portion 151 toward the fixed scroll 140. The orbiting wrap 152 is engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

For example, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate portion 151, and the rotation shaft coupling portion 153 may be formed through the central portion of the orbiting end plate portion 151 in the axial direction.

The eccentric portion 1254 of the rotation shaft 125 is rotatably inserted into the rotation shaft coupling portion 153. An outer circumferential part of the rotation shaft coupling portion 153 is connected to the orbiting wrap 152 to define the compression chamber V together with the fixed wrap 144 during a compression process.

The rotation shaft coupling portion 153 may be formed at a height at which it overlaps the orbiting wrap 152 on the same plane. That is, the rotation shaft coupling portion 153 may be disposed at a height at which the eccentric portion 1254 of the rotation shaft 125 overlaps the orbiting wrap 152 on the same plane. Accordingly, repulsive force and compressive force of refrigerant can cancel each other while being applied to the same plane based on the orbiting end plate portion 151, and thus inclination of the orbiting scroll 150 due to interaction between the compressive force and the repulsive force can be suppressed.

The rotation shaft coupling portion 153 may include a coupling side portion (not illustrated) that is in contact with an outer circumference of an orbiting bearing 173 to support the orbiting bearing 173.

In addition, the rotation shaft coupling portion 153 may further include a coupling end portion (not illustrated) that is in contact with one end of the orbiting bearing 173 to support the orbiting bearing 173.

The coupling side portion is formed on an inner circumference of the rotation shaft coupling portion 153 to come in contact with an outer circumference of the orbiting bearing 173, and the coupling end portion is in contact with the upper end of the orbiting bearing 173 to support the orbiting bearing 173.

On the other hand, the compression chamber V is formed in a space defined by the fixed end plate portion 141, the fixed wrap 144, the orbiting end plate portion 151, and the orbiting wrap 152. The compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

That is, since the scroll compressor 10 according to the present disclosure has the structure in which the rotation shaft 125, the orbiting scroll 150, and the fixed scroll 140 are sequentially assembled together, the outer diameter of the sub bearing portion 52 must be smaller than twice the eccentricity of the inner diameter of the orbiting scroll 150.

In addition, there was a reliability problem due to high surface pressure on the bearing of the fixed scroll 140, and if the bearing of the fixed scroll 140 was enlarged to reduce the surface pressure, the bearing of the orbiting scroll 150 also had to be enlarged for assembly, so the compression space was bound to be reduced.

The scroll compressor according to the embodiment of the present disclosure may operate as follows.

That is, when power is applied to the drive motor 120, rotational force is generated and the rotor 122 and the rotation shaft 125 rotate accordingly. As the rotation shaft 125 rotates, the orbiting scroll 150 eccentrically coupled to the rotation shaft 125 performs an orbiting motion relative to the fixed scroll 140 by the Oldham ring 180.

Accordingly, a volume of a compression chamber V decreases gradually along a suction pressure chamber Vs defined at an outer side of the compression chamber V, an intermediate pressure chamber Vm continuously formed toward a center, and a discharge pressure chamber Vd defined in a central portion.

Then, refrigerant moves to the accumulator (not illustrated) sequentially via a condenser (not illustrated), an expander (not illustrated), and an evaporator 50 of a refrigeration cycle. The refrigerant then flows toward the suction pressure chamber Vs forming the compression chamber V through the refrigerant suction pipe 115.

The refrigerant suctioned into the suction pressure chamber Vs is compressed while moving to the discharge pressure chamber Vd via the intermediate pressure chamber Vm along a movement trajectory of the compression chamber V. The compressed refrigerant is discharged from the discharge pressure chamber Vd to the outflow space S12 of the discharge cover 60 through the discharge port 1411, 1412.

Then, the refrigerant discharged to the discharge space S12 of the discharge cover 160 may be mixed refrigerant with oil. However, mixed refrigerant or refrigerant in the description moves to the outflow space S12 defined between the main frame 130 and the driving motor 120 through the outflow hole accommodating groove 1613 of the discharge cover 160 and the first outflow hole 142*c* of the fixed scroll 140. The mixed refrigerant passes through the driving motor 120 to move to the upper space S2 of the casing 110 defined above the driving motor 120.

The mixed refrigerant moved to the upper space S2 is separated into refrigerant and oil in the upper space S2. The refrigerant (or some mixed refrigerant from which oil is not separated) flows out of the casing 110 through the refrigerant discharge pipe 116 so as to move to the condenser of the refrigeration cycle.

On the other hand, the oil separated from the refrigerant in the upper space S2 (or mixed oil with liquid refrigerant) moves to the lower space S1 along the first oil return passage Po1 between the inner circumferential surface of the casing 110 and the stator 121. The oil moved to the lower space S1 is returned to the oil storage space S11 defined in the lower portion of the compression part along the second oil return passage Po2 between the inner circumferential surface of the casing 10 and the outer circumferential surface of the compression part.

This oil is thusly supplied to each bearing surface (not illustrated) through the oil feeding passage 126, and partially supplied into the compression chamber V. The oil supplied to the bearing surfaces and the compression chamber V is discharged to the discharge cover 160 together with refrigerant and then returned. This series of processes is repeatedly performed.

At this time, the oil groove 245*b* is formed between the bushing 245 and the rotation shaft 125 and oil flowing into the oil groove 245*b* forms the oil film 245*c*, thereby suppressing refrigerant leakage. This enables the differential pressure oil supply system in the compression part to operate normally without any problems.

As the bushing 145, 245 is provided between the fixed bearing portion 1253 and the fixed bearing 172, the fixed bearing 172 installed on the inner circumference of the fixed scroll 140 can have a relatively wide diameter by the outer diameter of the bushing 145, 245, the surface pressure applied to the fixed bearing 172 can be reduced, and the Sommerfeld number can be increased.

The aforementioned scroll compressor 10, 20 is not limited to the configuration and the method of the embodiments described above, but the embodiments may be configured such that all or some of the embodiments are selectively combined so that various modifications can be made.

It will be apparent to those skilled in the art that the present disclosure may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

INDUSTRIAL APPLICABILITY

The present disclosure may be applied to a scroll compressor for reducing wear of a sliding part due to reduced lubrication of a compression part caused by a gap between a shaft and a concentric bushing.

The invention claimed is:

1. A scroll compressor, comprising:

a casing that defines an appearance thereof and has an oil storage space;

an electromotive part that is installed inside of the casing to generate a drive force;

a rotational shaft that is rotatably installed in the electromotive part;

a compression part that comprises an orbiting scroll installed on the rotational shaft to perform an orbital motion, and a fixed scroll engaged with the orbiting scroll to form a compression chamber together with the orbiting scroll; and a bushing that is disposed between the fixed scroll and the rotational shaft, and coupled to an outer circumference of the rotational shaft to rotate together with the rotational shaft, wherein the bushing is supported by one surface defined inside of the fixed scroll, wherein the bushing comprises an oil supply hole formed such that an inside and an outside of the bushing communicate with each other, wherein the rotational shaft comprises an oil supply opening formed to communicate with the oil supply hole, wherein an oil groove is formed in an inner circumference of the bushing or the outer circumference of the rotational shaft, and wherein the oil groove is formed in a circumferential direction to enable formation of an oil film while oil is accommodated in the oil groove.

2. The scroll compressor of claim 1, further comprising a fixed bearing that is disposed between the fixed scroll and the bushing and fitted to an inner circumference of the fixed scroll, wherein the bushing is supported on an inner surface of the fixed bearing.

3. The scroll compressor of claim 2, wherein at least one pin is inserted into the outer circumference of the rotational shaft in a radial direction, wherein the bushing comprises at least one pin coupling hole into which the at least one pin is inserted to be supported in the radial direction, wherein the at least one pin coupling hole comprises a plurality of pin coupling holes provided in an outer circumference of the bushing along the circumferential direction, and wherein the at least one pin comprises a plurality of pins to be inserted into the plurality of pin coupling holes, respectively.

4. The scroll compressor of claim 2, wherein the rotational shaft comprises:

a fixed bearing portion that is installed to be coupled to the inner circumference of the fixed scroll; and an eccentric part that is connected to the fixed bearing portion, arranged on an inner circumference of the orbiting scroll, and eccentrically arranged on the fixed bearing portion to enable the orbiting scroll to orbitally rotate eccentrically by a rotational force transmitted from the electromotive part, wherein the bushing is arranged concentrically with the fixed bearing portion.

5. The scroll compressor of claim 2, wherein an anti-separation member is installed on the outer circumference of the rotational shaft to support the lower surface of the bushing, such that the bushing is supported in an axial direction, wherein the rotational shaft comprises a fixed bearing portion that is installed to be coupled to the inner circumference of the fixed scroll, and wherein the fixed bearing portion comprises an anti-separation receiving groove formed concavely in the circumferential direction in an outer circumference of the fixed bearing portion to receive the anti-separation member.

6. The scroll compressor of claim 2, wherein a key receiving groove is formed in the outer circumference of the rotational shaft in an axial direction, wherein a key is installed in the key receiving groove to protrude in a radial direction of the rotational shaft, and wherein a support groove is formed in the inner circumference of the bushing, such that the key is fitted to support the bushing in the circumferential direction.

7. The scroll compressor of claim 6, wherein the key and the support groove are formed so that an axial length is longer thereof than a radial length.

8. The scroll compressor of claim 2, wherein the rotational shaft to which the bushing is coupled comprises a large-diameter portion and a small-diameter portion formed on portions in contact with the bushing and having different diameters, and wherein the bushing comprises a first hole that receives and supports the large-diameter portion, and a second hole that receives and supports the small-diameter portion.

9. The scroll compressor of claim 8, wherein the large-diameter portion comprises a support surface formed on at least a portion of an outer circumference thereof by cutting an outer circumferential surface in a tangential direction, and supports the first hole of the bushing, and wherein the first hole of the bushing comprises a holding surface formed in parallel to the support surface to support the support surface.

10. The scroll compressor of claim 9, wherein the support surface is provided by two surfaces disposed in parallel to each other on the outer circumference of the rotational shaft, and wherein the holding surface is provided by two surfaces disposed in parallel to correspond to the support surfaces.

11. The scroll compressor of claim 8, wherein the large-diameter portion comprises a support end portion disposed on a bottom surface thereof to axially support the bushing between the large-diameter portion and the small-diameter portion, and wherein a mounting surface is disposed on a top of the second hole, and mounted on the support end portion.

12. The scroll compressor of claim 1, wherein the oil groove comprises an oil film forming portion formed in the circumferential direction together with the outer circumference of the rotational shaft or the inner circumference of the bushing, and filled with oil, or wherein a gap passage is formed between the inner circumference of the bushing and the outer circumference of the rotational shaft, to allow oil to flow into the oil groove therethrough.

13. The scroll compressor of claim 1, wherein a passage groove is formed concavely by a predetermined width in an outer circumference of the bushing to communicate with the oil supply hole, so that oil is guided toward the fixed scroll, and wherein the passage groove is formed to receive the oil supply hole therein, or wherein the passage groove is formed up to a top of the bushing.

14. The scroll compressor of claim 13, wherein the oil groove in the inner circumference of the bushing and the oil groove in the outer circumference of the rotational shaft are disposed at a same height, or wherein the oil groove in the inner circumference of the bushing and the oil groove in the outer circumference of the shaft are disposed to be spaced apart from each other in one direction.

15. The scroll compressor of claim 1, wherein the oil groove communicates with the oil supply hole or the oil supply opening, and wherein the oil groove is spaced downwardly or upwardly apart from the oil supply hole or the oil supply opening.

16. The scroll compressor of claim 15, wherein a pin is inserted into the outer circumference of the rotational shaft in the radial direction, and wherein the bushing comprises a pin coupling hole into which the pin is inserted to be supported in the radial direction.

17. The scroll compressor of claim 1, wherein the oil supply opening is spaced apart from the oil supply hole in one direction.

18. The scroll compressor of claim 17, wherein a pin is inserted into the outer circumference of the rotational shaft in a radial direction, and wherein the bushing comprises a pin coupling hole into which the pin is inserted to be supported in the radial direction.

19. The scroll compressor of claim 1, wherein oil grooves are formed respectively in the inner circumference of the bushing and the outer circumference of the rotational shaft, and wherein the oil grooves in the inner circumference of the bushing and the outer circumference of the rotational shaft are formed in the circumferential direction to enable formation of an oil film while oil is accommodated in the oil grooves.

* * * * *